US010627770B2

(12) United States Patent
Kobayashi

(10) Patent No.: US 10,627,770 B2
(45) Date of Patent: Apr. 21, 2020

(54) IMAGE FORMING UNIT AND IMAGE FORMING APPARATUS

(71) Applicant: Oki Data Corporation, Tokyo (JP)

(72) Inventor: Yuuki Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/517,384

(22) Filed: Jul. 19, 2019

(65) Prior Publication Data

US 2020/0073316 A1 Mar. 5, 2020

(30) Foreign Application Priority Data

Aug. 30, 2018 (JP) ..... 2018-161408

(51) Int. Cl.
*G03G 21/12* (2006.01)
*G03G 21/10* (2006.01)
*G03G 15/08* (2006.01)

(52) U.S. Cl.
CPC ..... *G03G 21/12* (2013.01); *G03G 15/0891* (2013.01); *G03G 21/10* (2013.01); *G03G 21/105* (2013.01)

(58) Field of Classification Search
CPC ..... G03G 21/10; G03G 21/12; G03G 21/105; G03G 15/0891
See application file for complete search history.

(56) References Cited

U.S. PATENT DOCUMENTS 5,307,129 A * 4/1994 Miura ..... G03G 15/0856 222/DIG. 1
6,266,511 B1 * 7/2001 Murakami ..... G03G 21/105 222/DIG. 1
2009/0087228 A1 * 4/2009 Suzuki ..... G03G 15/0844 399/263
2009/0232559 A1 9/2009 Ushikubo
2010/0232852 A1 * 9/2010 Noso ..... G03G 21/105 399/358
2014/0093296 A1 4/2014 Nakajima
2014/0133893 A1 * 5/2014 Ushikubo ..... G03G 21/0029 399/350
2015/0098726 A1 * 4/2015 Kobayashi ..... G03G 21/0035 399/102

FOREIGN PATENT DOCUMENTS

JP 2006330316 A 12/2006
JP 2014238536 A 12/2014

* cited by examiner

*Primary Examiner* — Ryan D Walsh
(74) *Attorney, Agent, or Firm* — Rabin & Berdo, P.C.

(57) ABSTRACT

An image forming unit includes an image bearing body, a developer storage section that stores a developer removed from a surface of the image bearing body, a frame surrounding the developer storage section, a developer conveying member that conveys the developer in the developer storage section in a predetermined conveying direction, and a convex portion that is provided in the frame and pushes the developer conveying member toward the image bearing body.

16 Claims, 17 Drawing Sheets

IMAGE FORMING UNIT AND IMAGE FORMING APPARATUS

BACKGROUND OF THE INVENTION

1. Field of the Invention

The present invention relates to an image forming unit and an image forming apparatus that form an image using electrophotography.

2. Description of the Related Art

In an image forming unit that forms an image using electrophotography, a toner image is formed on a surface of a photosensitive drum, and is transferred to a medium such as a printing sheet. The toner remaining on a surface of the photosensitive drum after transferring is scraped by a cleaning member, and is stored in a waste toner storage section. The toner stored in the waste toner storage section is conveyed outside by a waste toner conveying member. See, for example, Japanese Patent Application Publication No. 2014-238536 (see FIG. 5).

SUMMARY OF THE INVENTION

In this regard, there are cases where paper dust on the medium such as a printing sheet may stick to the photosensitive drum, and may be scraped together with the toner by the cleaning member. The toner mixed with the paper dust has low flowability and can hardly be conveyed by the waste toner conveying member. Such toner tends to be accumulated in the waste toner storage section. If the toner mixed with the paper dust is accumulated in the waste toner storage section, it may lead to leakage of the toner.

The present invention is intended to solve the above described problem, and an object of the present invention is to efficiently convey a developer in a developer storage section to thereby inhibit leakage of the developer.

According to an aspect of the present invention, there is provided an image forming unit including an image bearing body, a developer storage section that stores a developer removed from a surface of the image bearing body, a frame surrounding the developer storage section, a developer conveying member that conveys the developer in the developer storage section in a predetermined direction, and a convex portion that is provided in the frame and pushes the developer conveying member toward the image bearing body.

An image forming apparatus according to the present invention includes the above described image forming unit.

With such a configuration, since the developer conveying member is pushed toward the image bearing body by the convex portion, the developer whose flowability is lowered by mixture with paper dust can easily be conveyed by the developer conveying member. As a result, accumulation of the developer can be inhibited, and thus leakage of the developer can be inhibited.

DETAILED DESCRIPTION OF THE PREFERRED EMBODIMENT

First Embodiment

<Configuration of Image Forming Apparatus>

Figure 1:
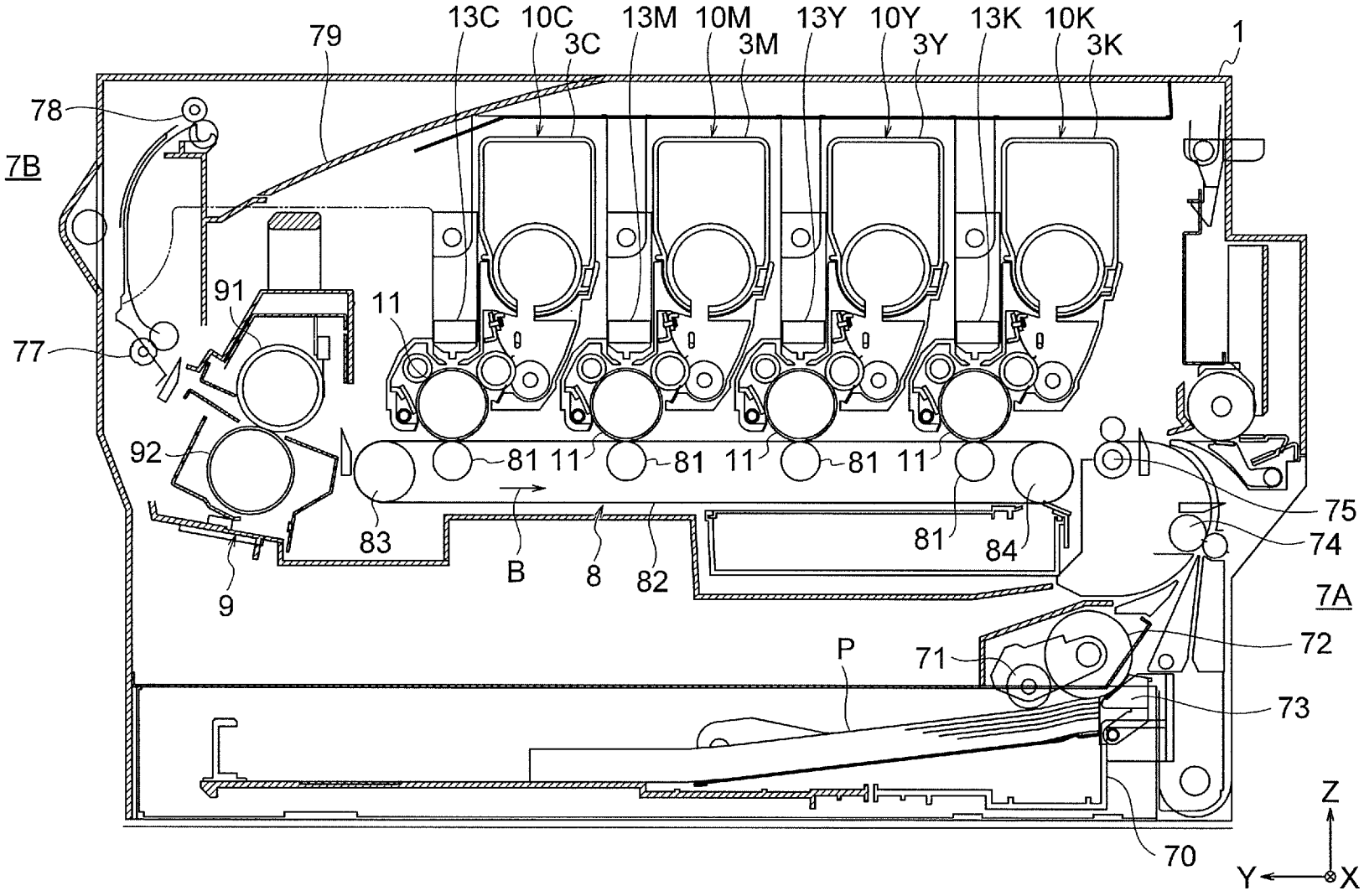
FIG. 1 is a view illustrating an image forming apparatus according to a first embodiment.

An image forming apparatus 1 according to a first embodiment will be described below. FIG. 1 is a view illustrating the image forming apparatus 1 according to the first embodiment. The image forming apparatus 1 is configured as a printer (more specifically, a color electrophotographic printer) that forms a color image using electrophotography. The image forming apparatus 1 includes a medium supplying section 7A, an image forming section 5, a fixing device 9, and a medium ejection section 7B. The medium supplying section 7A supplies a medium P such as a printing sheet. The image forming section 5 forms a toner image (i.e., a developer image) on the medium P supplied by the medium supplying section 7A. The fixing device 9 fixes the toner image to the medium P. The medium ejection section 7B ejects the medium P to which the toner image is fixed.

The medium supplying section 7A includes a tray 70 as a medium storage section, a hopping roller 71 as a delivery member, a feeding roller 72, a separation pad 73, and two pairs of conveying rollers 74 and 75. The tray 70 stores a stack of media P. The hopping roller 71 delivers the medium P stored in the tray 70. The feeding roller 72 and the separation pad 73 separate the delivered medium P from the succeeding media P and feed the medium P to a medium conveyance path. The conveying rollers 74 and 75 convey the media P to the image forming section 5.

The image forming section 5 includes four process units 10K, 10Y, 10M, and 10C as image forming units, and a transfer unit 8. The process units 10K, 10Y, 10M, and 10C form toner images of black (K), yellow (Y), magenta (M), and cyan (C). The transfer unit 8 transfers the toner images to a surface of the medium P by Coulomb force.

The process units 10K, 10Y, 10M, and 10C are arranged in this order from an upstream side to a downstream side (from the right to the left in FIG. 1) in a conveying direction of the medium P. Printing heads 13K, 13Y, 13M, and 13C as exposure devices are provided so as to face photosensitive drums 11 (described later) of the process units 10K, 10Y, 10M, and 10C.

The process units 10K, 10Y, 10M, and 10C will be referred to as process units (image forming units) 10 unless it is necessary to distinguish them. The printing heads 13K, 13Y, 13M, and 13C will be referred to as printing heads 13 unless it is necessary to distinguish them.

Figure 2:
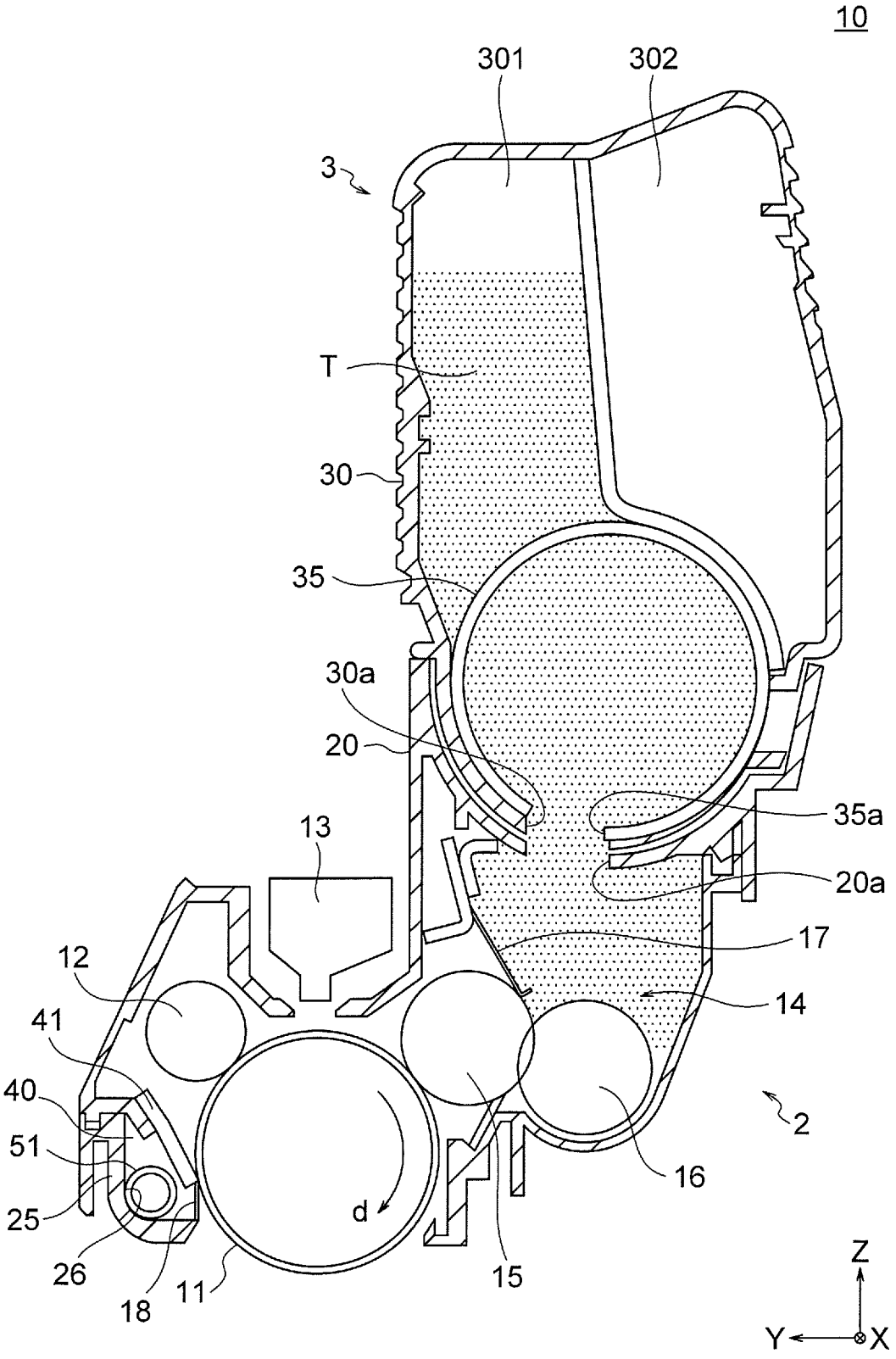
FIG. 2 is a sectional view illustrating a process unit according to the first embodiment.
Figure 14:
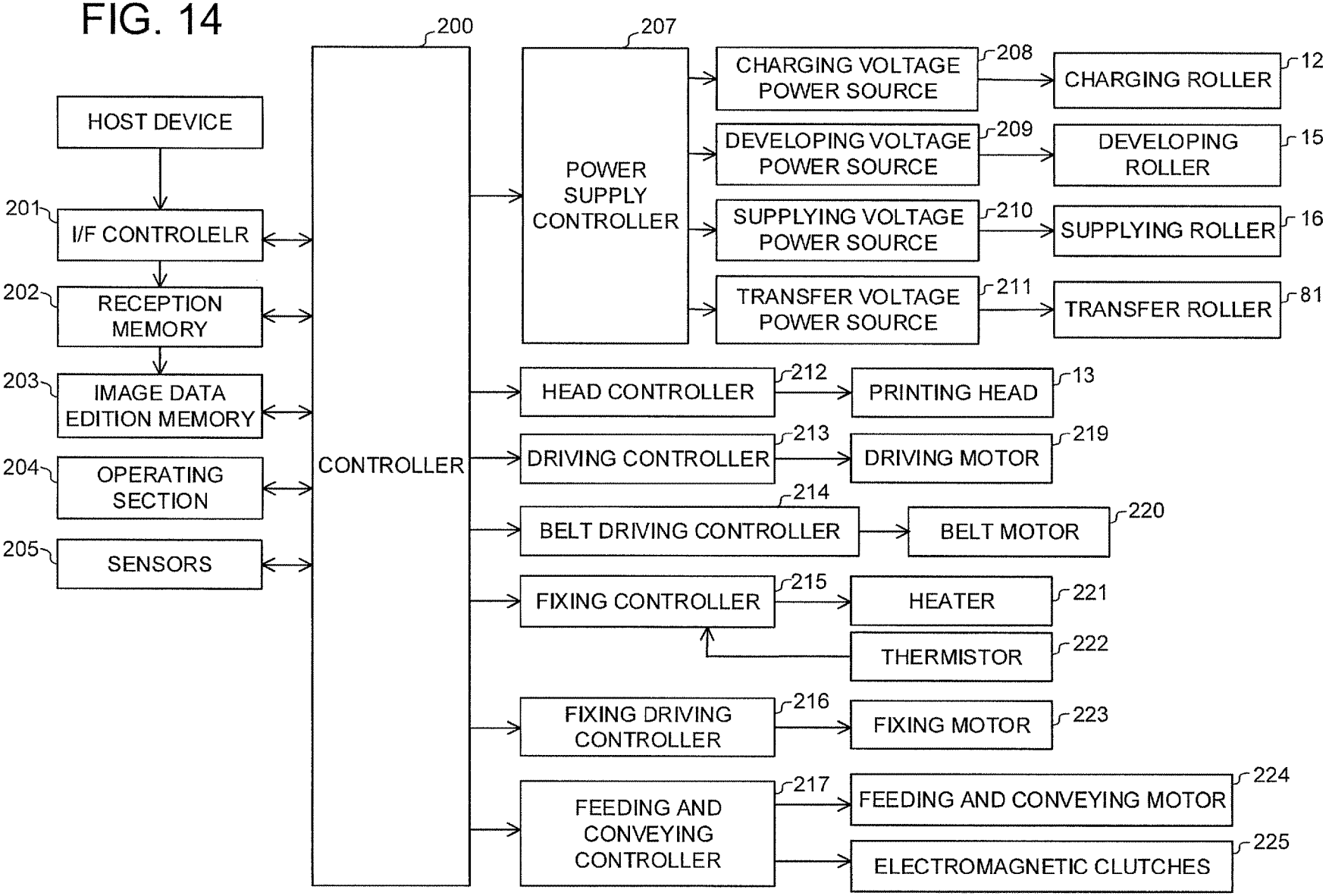
FIG. 14 is a block diagram illustrating a control system of the image forming apparatus according to the first embodiment.

FIG. 2 is a sectional view illustrating an internal configuration of the process unit 10. The process unit 10 includes a photosensitive drum 11 as an image bearing body. The photosensitive drum 11 is a cylindrical member having a photosensitive layer on its surface, and is rotated in one direction (indicated by an arrow d) by a driving motor 219 (FIG. 14).

A charging roller 12 as a charging member, the printing head 13 as an exposure device, a developing section 14, and a cleaning blade 41 as a cleaning member are provided around the photosensitive drum 11 in a rotating direction of the photosensitive drum 11.

The charging roller 12 is provided in contact with the photosensitive drum 11, and rotates to follow a rotation of the photosensitive drum 11. The charging roller 12 is applied with a charging voltage by a charging voltage power source 208 (FIG. 14), and uniformly charges the surface of the photosensitive drum 11.

The printing head 13 includes, for example, a lens array, and a board on which LEDs (Light Emitting Diodes) and a driving circuit are mounted. The printing head 13 is disposed at a position where light emitted by the LEDs is focused on the surface of the photosensitive drum 11. As the surface of the photosensitive drum 11 is exposed with light emitted by the printing head 13, an electrical potential on the exposed portion of the photosensitive drum 11 attenuates, and an electrostatic latent image is formed.

The developing section 14 is configured to develop the electrostatic latent image using a nonmagnetic single-component toner as a developer. The developing section 14 includes a developing roller 15 as a developer bearing body, a supplying roller 16 as a supplying member, and a developing blade 17. The developing roller 15 is provided in contact with the photosensitive drum 11. The supplying roller 16 is provided in contact with or facing the developing roller 15. The developing blade 17 is pressed against the developing roller 15.

The developing roller 15 is applied with a developing voltage having the same polarity (for example, negative polarity) as a charging polarity of the photosensitive drum 11 by a developing voltage power source 209 (FIG. 14), and causes the toner to adhere to the exposed portion of the photosensitive drum 11. The supplying roller 16 is applied with a supplying voltage by a supplying voltage power source 210 (FIG. 14), and supplies the toner to the developing roller 15. The developing blade 17 regulates a thickness of a toner layer formed on a surface of the developing roller 15.

The cleaning blade 41 removes the toner (i.e., transfer residual toner) remaining on the surface of the photosensitive drum 11 after transferring of the toner image. The cleaning blade 41 will be described in detail later.

Referring back to FIG. 1, the transfer unit 8 includes a transfer belt 82, four transfer rollers 81, a driving roller 83, and a tension roller 84. The transfer belt 82 conveys the medium P. The transfer rollers 81 are provided facing the photosensitive drums 11 of the respective process units 10 across the transfer belt 82. The driving roller 83 drives the transfer belt 82. The tension roller 84 applies tension to the transfer belt 82.

Each transfer roller 81 is applied with a voltage having a polarity opposite to a charging polarity of the toner by a transfer voltage power source 211 (FIG. 14). With this voltage, the toner images of respective colors formed on the photosensitive drums 11 are transferred to the medium P. The driving roller 83 is rotated by a belt motor 220 (FIG. 14) to cause the transfer belt 82 to travel in a direction indicated by an arrow B in FIG. 1.

The fixing device 9 includes, for example, a fixing roller 91, and a pressure roller 92 pressed against the fixing roller 91. The fixing roller 91 has a heater 221 (FIG. 14) as a heat source therein, and is rotated by a fixing motor 223 (FIG. 14). The fixing roller 91 and the pressure roller 92 apply heat and pressure to the toner image transferred to the medium P to thereby fix the toner image to the medium P.

The medium ejection section 7B includes two pairs of ejection rollers 77 and 78 that convey the medium P having passed the fixing device 9. The medium ejection section 7B ejects the medium P to which the toner image is fixed. The ejection rollers 77 and 78 are rotated by rotation transmitted from the fixing motor 223 (FIG. 14). An upper cover of the image forming apparatus 1 is provided with a stacker portion 79 on which the media P ejected by the medium ejection section 7B are stacked.

In FIG. 1, a moving direction of the medium P when the medium P passes through the process units 10K, 10Y, 10M, and 10C is defined as a Y direction. A direction of a rotation axis of the photosensitive drum 11 is defined as an X direction. The X direction is the same as a widthwise direction of the medium P. As for the Y direction, the moving direction of the medium P passing through the process units 10K, 10Y, 10M, and 10C is defined as a +Y direction, and its opposite direction is defined as a −Y direction. A direction perpendicular to both of the X direction and the Y direction is defined as a Z direction. In this example, the Z direction is a vertical direction.

<Configuration of Process Unit>

Next, a configuration of the process unit 10 will be described. The process unit 10 includes a unit main body 2, and a toner cartridge 3 detachably mounted on the unit main body 2, as illustrated in FIG. 2. The unit main body 2 includes a main body frame 20. The main body frame 20 houses the photosensitive drum 11, the charging roller 12, the developing section 14, and the cleaning blade 41.

The toner cartridge 3 as a developer storage body includes an outer case 30 and a shutter 35. The shutter 35 serves as an opening and closing member, and is disposed inside the outer case 30. The outer case 30 includes a toner storage chamber 301 and a waste toner storage chamber 302. The toner storage chamber 301 stores an unused toner (indicated by a reference symbol T in FIG. 2). The waste toner storage chamber 302 stores a waste toner.

The outer case 30 includes a toner supplying opening 30*a* on its bottom. The toner supplying opening 30*a* serves as an ejection portion through which the toner is ejected (i.e., supplied to the developing section 14). The shutter 35 is disposed in the outer case 30 so as to be rotatable about a rotation axis in the X direction.

The outer case 30 is a substantially cylindrical member with an upper side opened, and includes an opening 35*a* having substantially the same shape as the toner supplying opening 30*a*. The shutter 35 includes a lever 37 (FIG. 4) at its end in the +X direction. The shutter 35 is rotated by operation of the lever 37.

As illustrated in FIG. 2, when the opening 35*a* of the shutter 35 is at a position overlapping with the toner supplying opening 30*a*, the toner supplying opening 30*a* is opened. In this state, the toner is ejected from the toner supplying opening 30*a* and is supplied to the developing section 14 through a toner inlet opening 20*a* of the unit main body 2. When the opening 35*a* of the shutter 35 is in a position shifted from the toner supplying opening 30*a*, the toner supplying opening 30*a* is closed.

Figure 3:
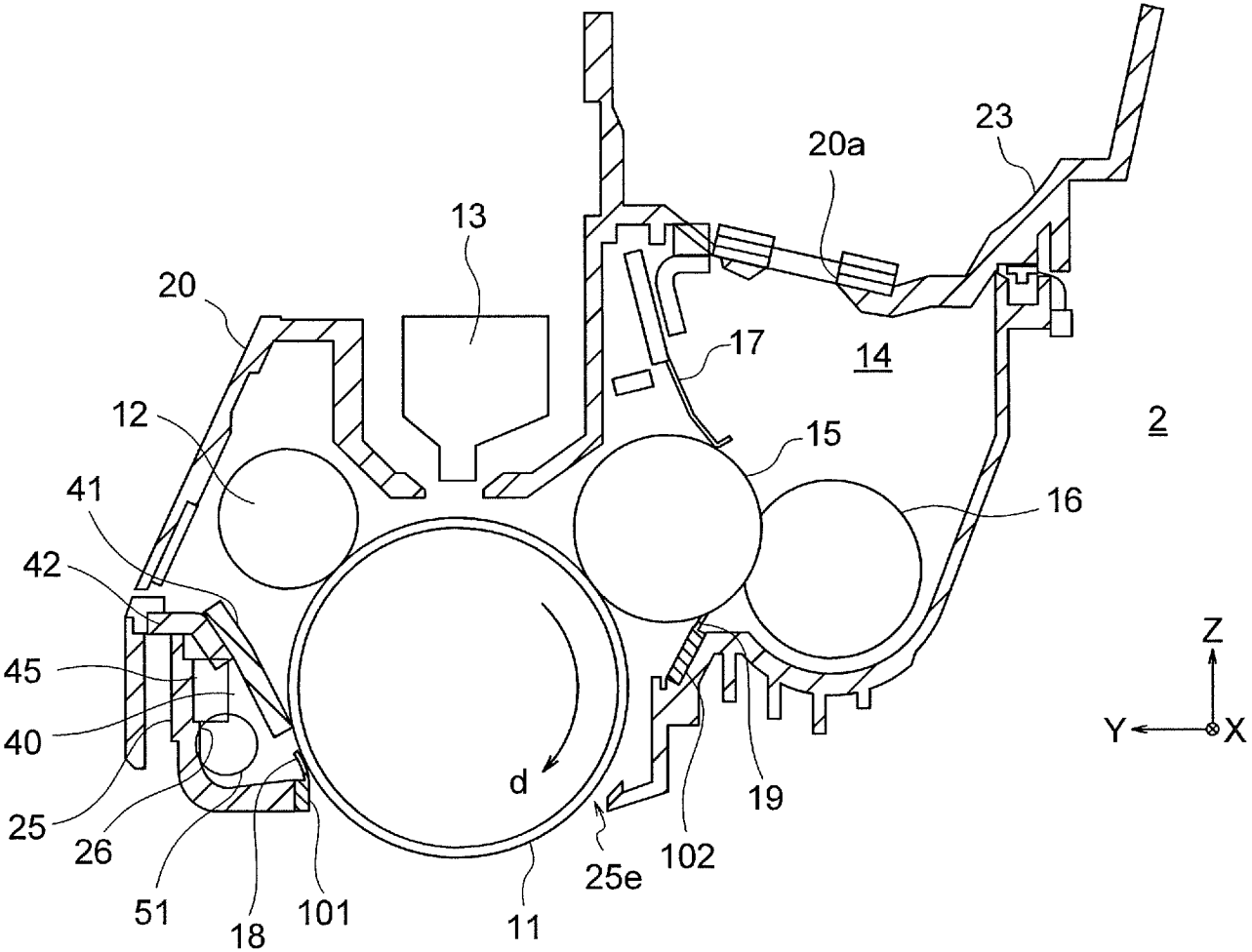
FIG. 3 is a sectional view illustrating a unit main body according to the first embodiment.

FIG. 3 is a sectional view illustrating the unit main body 2. A housing of the unit main body 2 includes a base frame 25 and a main body frame 20. The base frame 25 surrounds the photosensitive drum 11. The main body frame 20 covers an upper side (i.e., the +Z side) of the base frame 25. An opening 25*e* is formed on a bottom of the base frame 25. The photosensitive drum 11 faces the transfer belt 82 (or the medium P thereon) via the opening 25*e*.

The cleaning blade 41 is fixed to the base frame 25. The cleaning blade 41 is made of a resilient member such as urethane rubber. The cleaning blade 41 is elongated in the X direction, and has a rectangular cross-section in the YZ plane.

A length of the cleaning blade 41 in the X direction is substantially the same as that of the photosensitive drum 11.

A metal blade holder 42 for holding the cleaning blade 41 is fixed to the base frame 25. The cleaning blade 41 is fixed to the blade holder 42 so that one end of the cleaning blade 41 in the widthwise direction thereof contacts the surface of the photosensitive drum 11. The cleaning blade 41 scrapes the transfer residual toner from the surface of the photosensitive drum 11.

In the base frame 25, a waste toner storage section 40 as a developer storage section is provided below the cleaning blade 41. The waste toner storage section 40 stores the toner (i.e., the waste toner) scraped from the photosensitive drum 11. The waste toner storage section 40 extends over an entire region of the photosensitive drum 11 in the X direction. A waste toner conveying spiral 51 as a developer conveying member is provided in the waste toner storage section 40. The waste toner conveying spiral 51 conveys the waste toner in the X direction.

A sponge member 45 is disposed in the waste toner storage section 40 so that the sponge member 45 contacts an upper side (i.e., the +Z side) of the waste toner conveying spiral 51. The sponge member 45 is provided between the waste toner conveying spiral 51 and the blade holder 42. The sponge member 45 is provided for limiting a capacity of the waste toner storage section 40 so as to enhance conveyance efficiency of the waste toner conveying spiral 51.

A seal member 18 is fixed to the base frame 25. The seal member 18 closes a gap between the photosensitive drum 11 and the base frame 25. The seal member 18 is elongated in the X direction, and is fixed by a seal fixing member 101 to an end surface of the opening 25*e* of the base frame 25. The seal member 18 is flexible so as to allow passage of the toner adhering to the surface of the photosensitive drum 11. The seal fixing member 101 may be implemented as, for example, a double-sided adhesive tape.

A seal member 19 is fixed to the base frame 25. The seal member 19 closes a gap between the developing roller 15 and the base frame 25. The seal member 18 is elongated in the X direction, and is fixed to a bottom of the base frame 25 by a seal fixing member 102. The seal member 19 is flexible so as to allow passage of the toner adhering to the surface of the developing roller 15. The seal fixing member 102 may be implemented as, for example, a double-sided adhesive tape.

Figure 4:
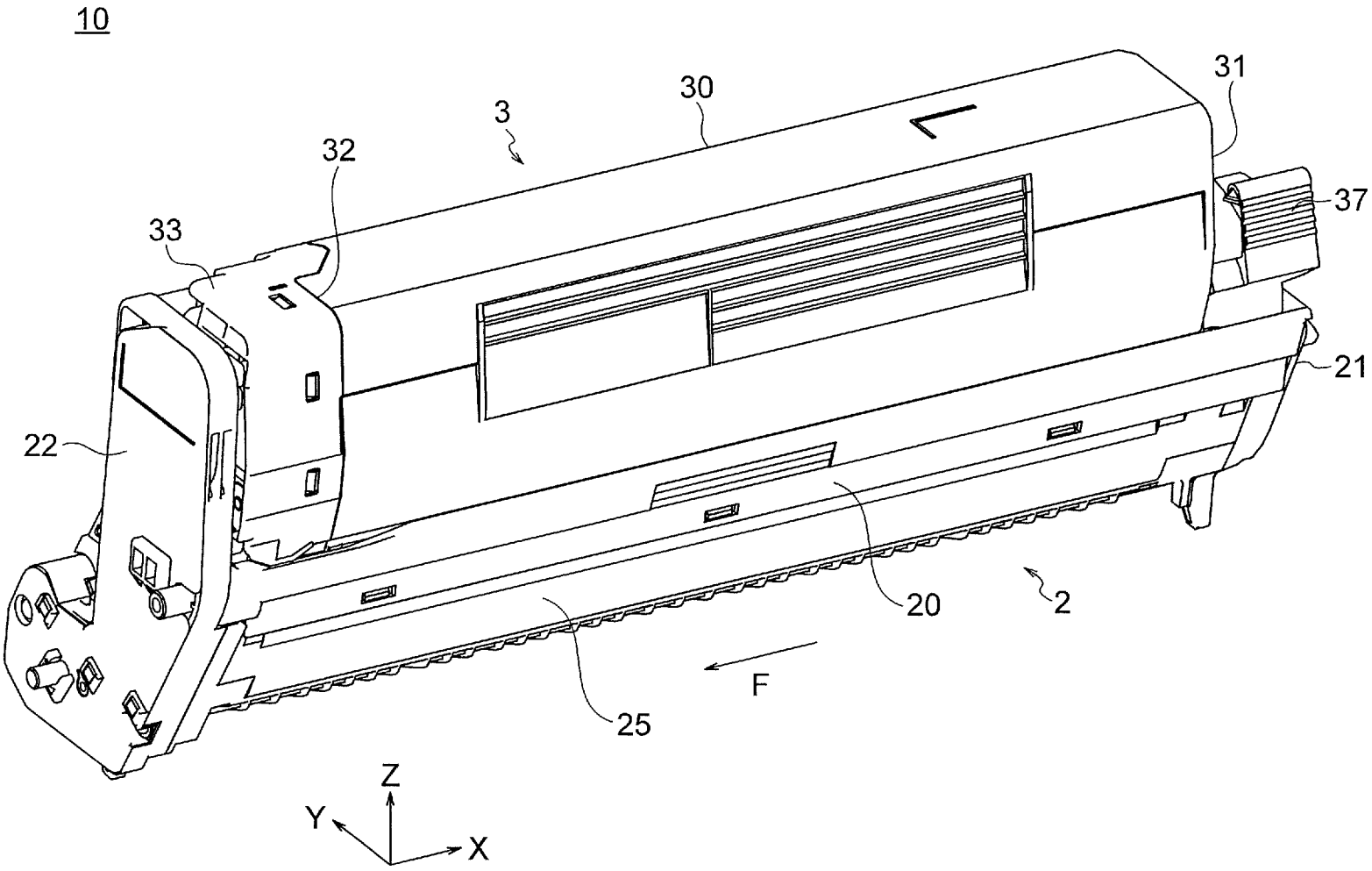
FIG. 4 is a perspective view illustrating an external appearance of the process unit according to the first embodiment.

FIG. 4 is a perspective view illustrating an external appearance of the process unit 10. The toner cartridge 3 is mounted on an upper side (i.e., the +Z side) of the unit main body 2. The outer case 30 of the toner cartridge 3 is elongated in the X direction. The outer case 30 includes a side plate 31 at its end in the +X direction and a side plate 32 at its end in the −X direction. A side cover 33 is mounted on the side plate 32.

Figure 5:
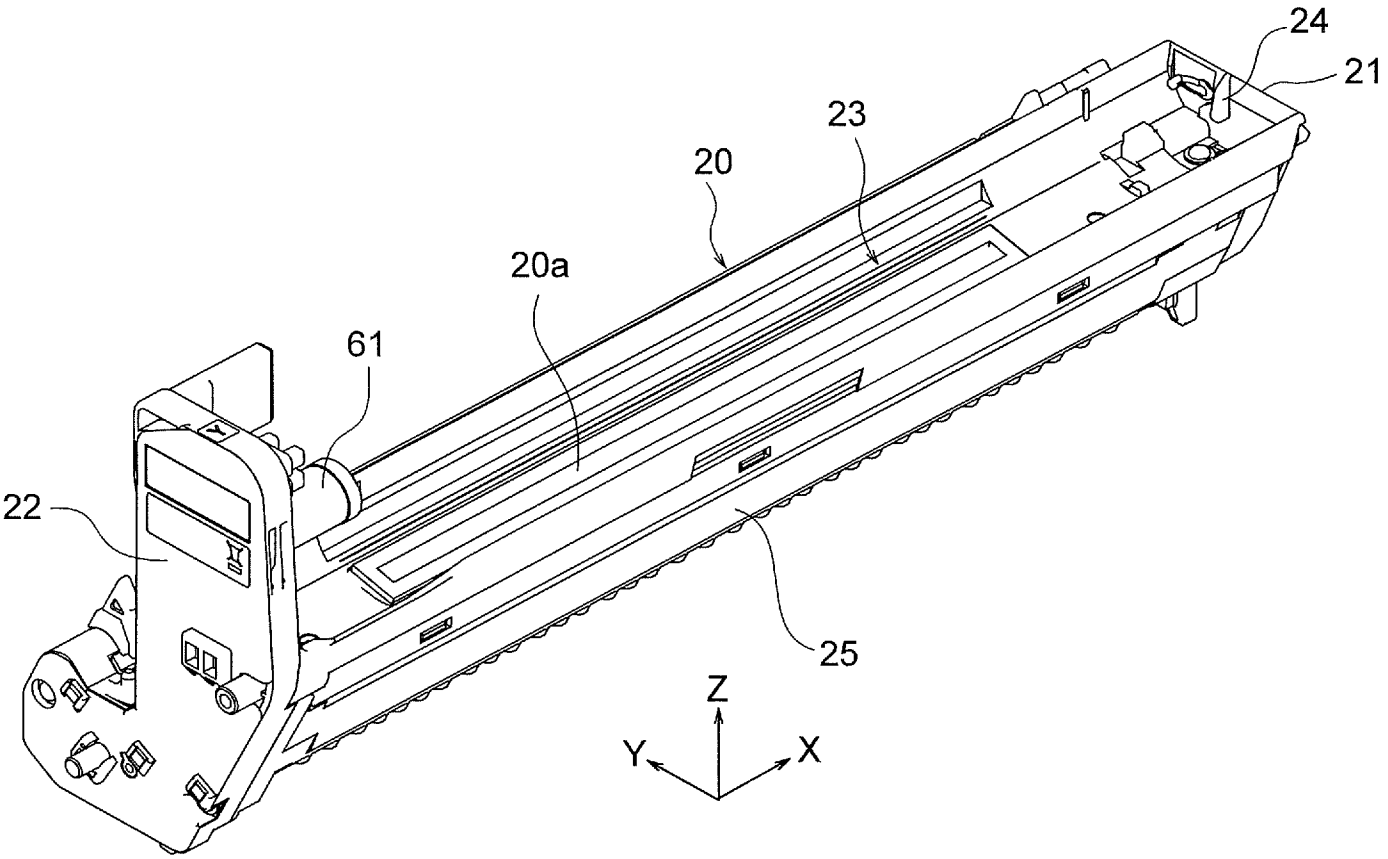
FIG. 5 is a perspective view illustrating a housing of the unit main body according to the first embodiment.

FIG. 5 is a perspective view illustrating a housing of the unit main body 2. The housing of the unit main body 2 includes the base frame 25, the main body frame 20, and a side frame 22. The main body frame 20 is disposed on the upper side (i.e., the +Z side) the base frame 25. The side frame 22 is disposed at an end of the base frame 25 in the −X direction. The main body frame 20 includes a side plate portion 21 at its end in the +X direction (i.e., an end of the main body frame 20 opposite to the side frame 22).

A cartridge mounting section 23 for mounting the toner cartridge 3 is formed on the main body frame 20. The cartridge mounting section 23 includes a concave shaped portion along a bottom of the toner cartridge 3 (i.e., a bottom of the outer case 30).

A toner inlet opening 20*a* is formed in the cartridge mounting section 23. The toner inlet opening 20*a* receives the toner ejected from the toner supplying opening 30*a* of the toner cartridge 3. A rib 24 or the like for locking the toner cartridge 3 is formed on the cartridge mounting section 23, but a detailed description thereof is omitted. The base frame 25 will be described in detail later.

Figure 6:
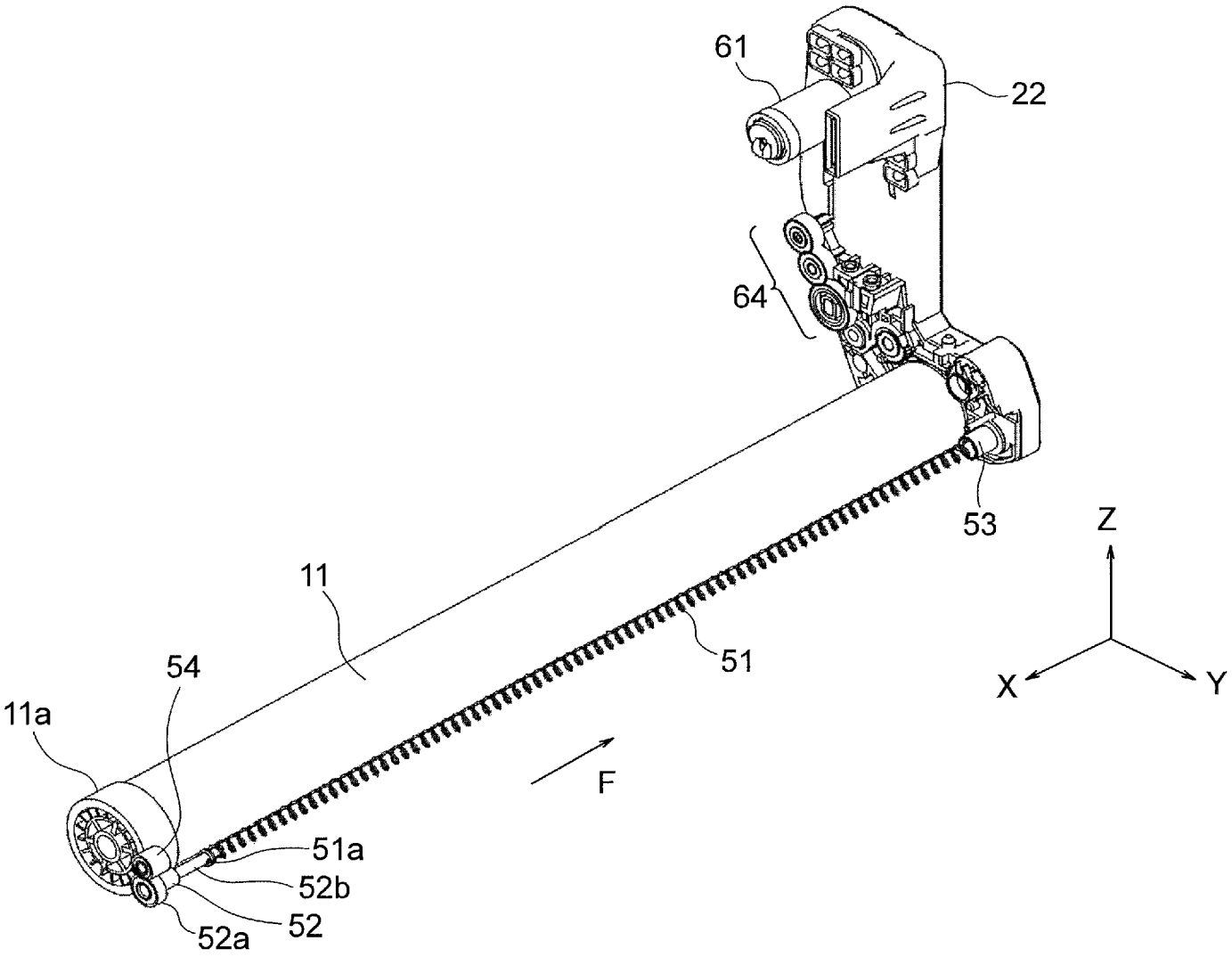
FIG. 6 is a perspective view illustrating a photosensitive drum, a waste toner conveying spiral, and a waste toner conveying mechanism according to the first embodiment.

FIG. 6 is a perspective view illustrating a configuration for conveying and collecting the toner (i.e., the waste toner) scraped from the surface of the photosensitive drum 11. The toner scraped from the photosensitive drum 11 by the cleaning blade 41 (FIG. 3) falls and is stored in the waste toner storage section 40 (FIG. 3).

The waste toner conveying spiral 51 is rotatably provided in the waste toner storage section 40. The waste toner conveying spiral 51 extends in the X direction along the surface of the photosensitive drum 11. The waste toner conveying spiral 51 rotates about a rotation axis in the X direction, and conveys the waste toner in a conveying direction (in this case, the −X direction) indicated by an arrow F.

The waste toner conveying spiral 51 is formed by spirally winding a wire made of metal such as stainless steel. A diameter of the wire is, for example, 0.8 mm. An outer diameter of the winding is, for example, 6 mm. A winding pitch is, for example, 5 mm.

A spiral holder 52 is mounted at an end 51*a* of the waste toner conveying spiral 51 in the +X direction. The spiral holder 52 includes a gear portion 52*a* and a shaft portion 52*b*. The gear portion 52*a* receives rotation transmitted from the photosensitive drum 11. The shaft portion 52*b* is fitted into an inner circumference of the waste toner conveying spiral 51. The spiral holder 52 is rotatably supported by the base frame 25 (FIG. 3).

An end of the waste toner conveying spiral 51 in the −X direction is inserted into a cylindrical portion 53 provided on the side frame 22, and is rotatably held in the cylindrical portion 53. The cylindrical portion 53 also functions as a path allowing passage of the waste toner conveyed by the waste toner conveying spiral 51 and guiding the waste toner to a waste toner conveying belt 62 (FIG. 7) in the side frame 22.

A substantially cylindrical waste toner supplying section 61 is formed on an upper portion of the side frame 22. The waste toner supplying section 61 is inserted into the waste toner storage chamber 302 (FIG. 2) of the toner cartridge 3 mounted on the unit main body 2.

Figure 7:
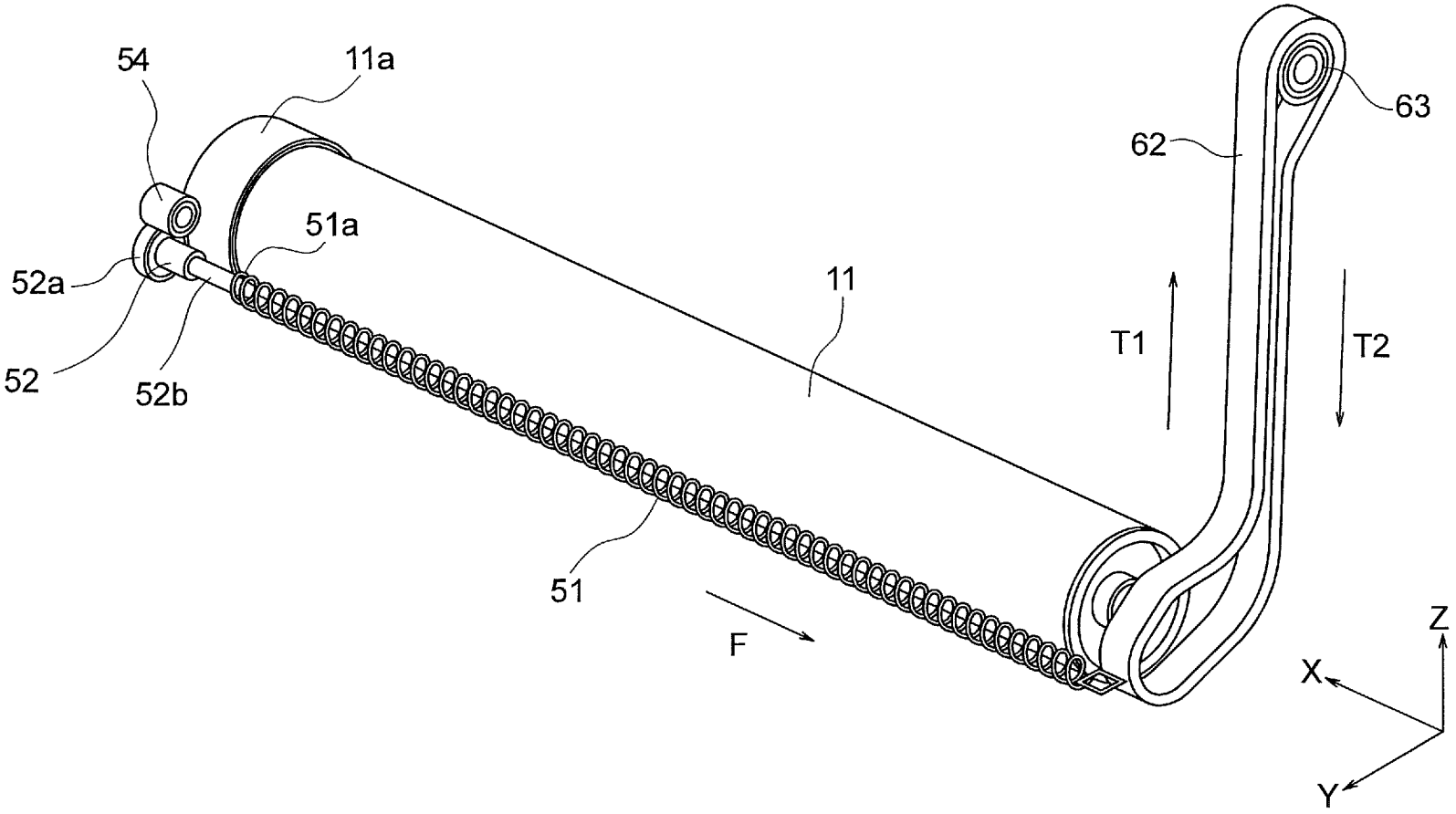
FIG. 7 is a perspective view illustrating the photosensitive drum, the waste toner conveying spiral, and a waste toner conveying belt according to the first embodiment.

FIG. 7 is a schematic view illustrating the waste toner conveying belt 62 (disposed in the side frame 22) together with the photosensitive drum 11 and the waste toner conveying spiral 51. The waste toner conveying belt 62 as a conveying member is disposed in the side frame 22 (FIG. 6). The waste toner conveying belt 62 conveys the waste toner (having been conveyed by the waste toner conveying spiral 51) to the waste toner supplying section 61.

The waste toner conveying belt 62 is held by a plurality of holding portions including a pulley 63 (only the pulley 63 is illustrated in FIG. 7), and is able to circulate in directions indicated by arrows T1 and T2 (i.e., the +Z direction and the −Z direction). The holding portions are provided on an inner circumferential side of the waste toner conveying belt 62. The pulley 63 is rotated by rotation transmitted from the photosensitive drum 11 by a gear train 64 (FIG. 6) provided in the side frame 22.

Figure 8:
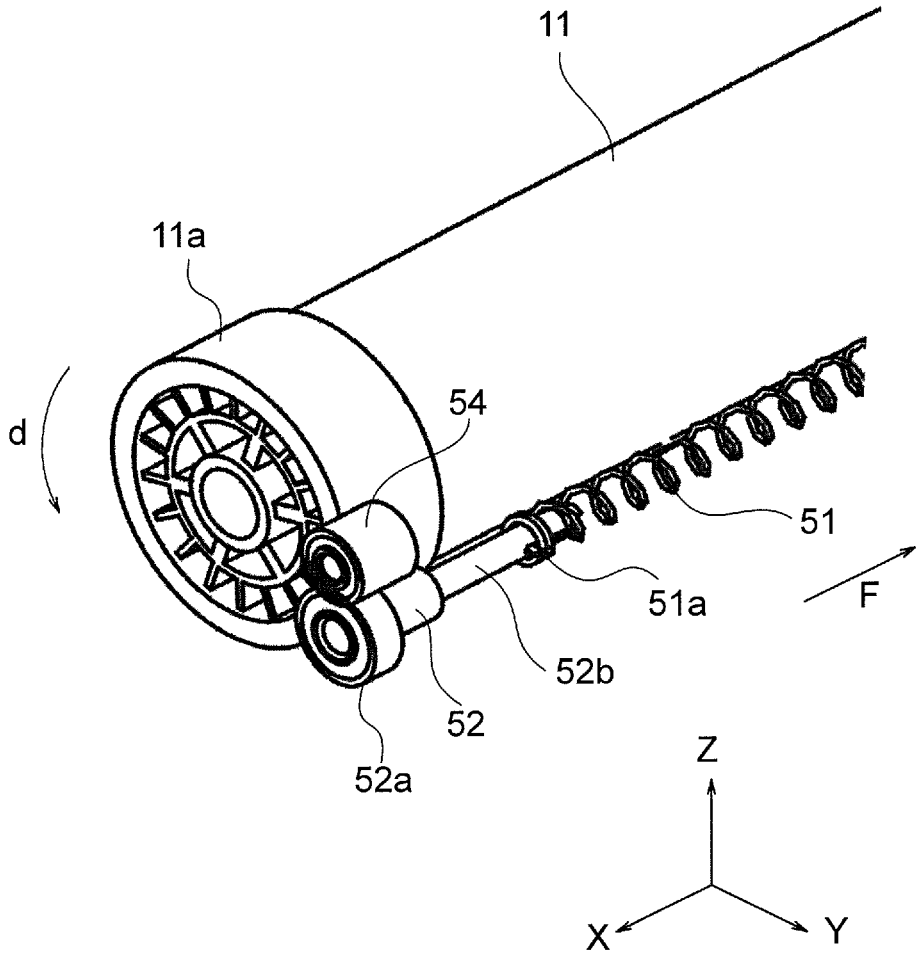
FIG. 8 is a perspective view illustrating a rotation transmitting portion between the photosensitive drum and the waste toner conveying spiral according to the first embodiment.

When the pulley 63 rotates, the waste toner conveying belt 62 moves and conveys the waste toner in the direction (+Z direction) indicated by the arrow T1. The waste toner conveyed by the waste toner conveying belt 62 is stored in the waste toner storage chamber 302 (FIG. 2) of the toner cartridge 3 through the waste toner supplying section 61. FIG. 8 is a view illustrating ends of the photosensitive drum 11 and the waste toner conveying spiral 51 in the +X direction. A drum gear 11*a* for receiving rotation transmitted from the driving motor 219 is formed at the end of the photosensitive drum 11 in the +X direction.

The drum gear 11*a* meshes with a transmission gear 54 (i.e., a rotation transmitting member) supported by the base frame 25. The transmission gear 54 meshes with the gear portion 52*a* of the spiral holder 52. When the photosensitive drum 11 rotates in the direction indicated by the arrow d, the spiral holder 52 rotates in the same direction by meshing between the drum gear 11*a*, the transmission gear 54, and the gear portion 52*a*.

The end 51*a* of the waste toner conveying spiral 51 is fixed to the spiral holder 52. Therefore, the waste toner conveying spiral 51 rotates together with the spiral holder 52, and conveys the waste toner in the conveying direction indicated by the arrow F.

Figure 9:
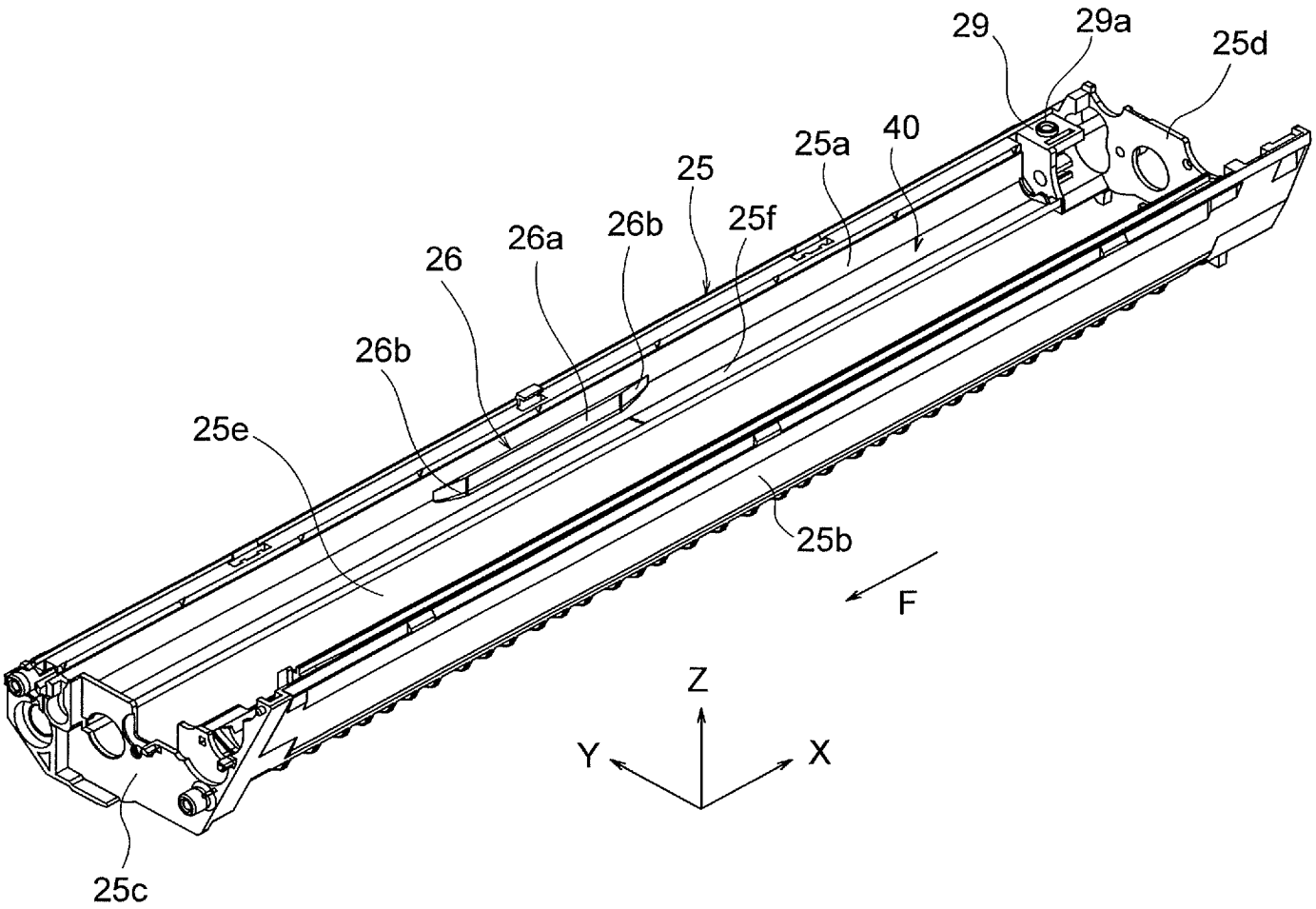
FIG. 9 is a perspective view illustrating a base frame according to the first embodiment.

FIG. 9 is a perspective view illustrating the base frame 25. The base frame 25 is made of, for example, resin such as modified polyphenylene ether (PPE/PS). The base frame 25 includes a first wall portion 25*a*, a second wall portion 25*b*, and side wall portions 25*c* and 25*d*. The first wall portion 25*a* is located at an end of the base frame 25 in the +Y direction. The second wall portion 25*b* is located at an end of the base frame 25 in the −Y direction. The side wall portions 25*c* and 25*d* are located at both ends of the base frame 25 in the X direction. The photosensitive drum 11 (FIG. 8) is housed in a space surrounded by the wall portions 25*a*, 25*b*, 25*c* and 25*d*.

A bottom plate portion 25*f* is formed on a lower side (on the −Z side) of the first wall portion 25*a*. A space surrounded by the first wall portion 25*a*, the bottom plate portion 25*f*, and the surface of the photosensitive drum 11 constitute a waste toner storage section 40. The opening 25*e* through which the photosensitive drum 11 faces the transfer belt 82 (or the medium P) is formed on the bottom of the base frame 25.

A mounting section 29 for mounting the blade holder 42 (FIG. 3) holding the cleaning blade 41 is formed at an end of the first wall portion 25*a* in the +X direction. The mounting section 29 includes a threaded hole 29*a*, and the blade holder is fixed to the mounting section 29 using a screw.

Although not illustrated in FIG. 9, a similar mounting section 29 is formed at an end of the first wall portion 25*a* in the −X direction.

A projecting portion 26 serving as a convex portion is formed at a central portion of the first wall portion 25*a* in the X direction. The projecting portion 26 projects from the first wall portion 25*a* in the −Y direction, that is, toward the photosensitive drum 11.

Figure 10:
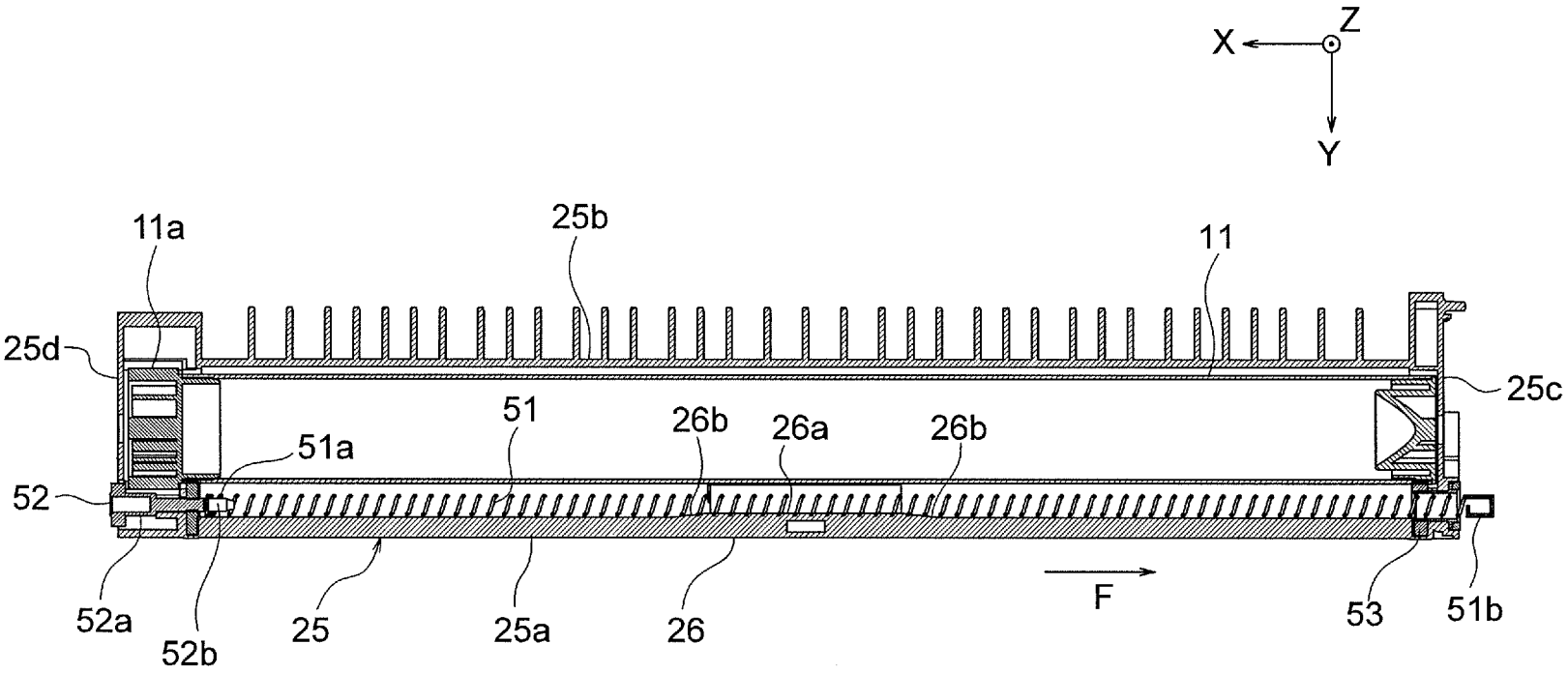
FIG. 10 is a sectional view illustrating the base frame according to the first embodiment.

FIG. 10 is a sectional view illustrating the unit main body 2, taken along a plane parallel to the XY plane and passing through the rotation axis of the photosensitive drum 11. The waste toner conveying spiral 51 extends in the X direction along the first wall portion 25*a*. The projecting portion 26 of the first wall portion 25*a* projects in the −Y direction, and pushes the central portion of the waste toner conveying spiral 51 (in the X direction) toward the photosensitive drum 11.

The projecting portion 26 includes a central portion 26*a* extending parallel to the X direction, and inclined portions 26*b* on both sides of the central portion 26*a* in the X direction. With this configuration, the projecting portion 26 allows the waste toner conveying spiral 51 to smoothly curve in an arcuate shape so as to reduce rotational load of the waste toner conveying spiral 51.

Figure 11:
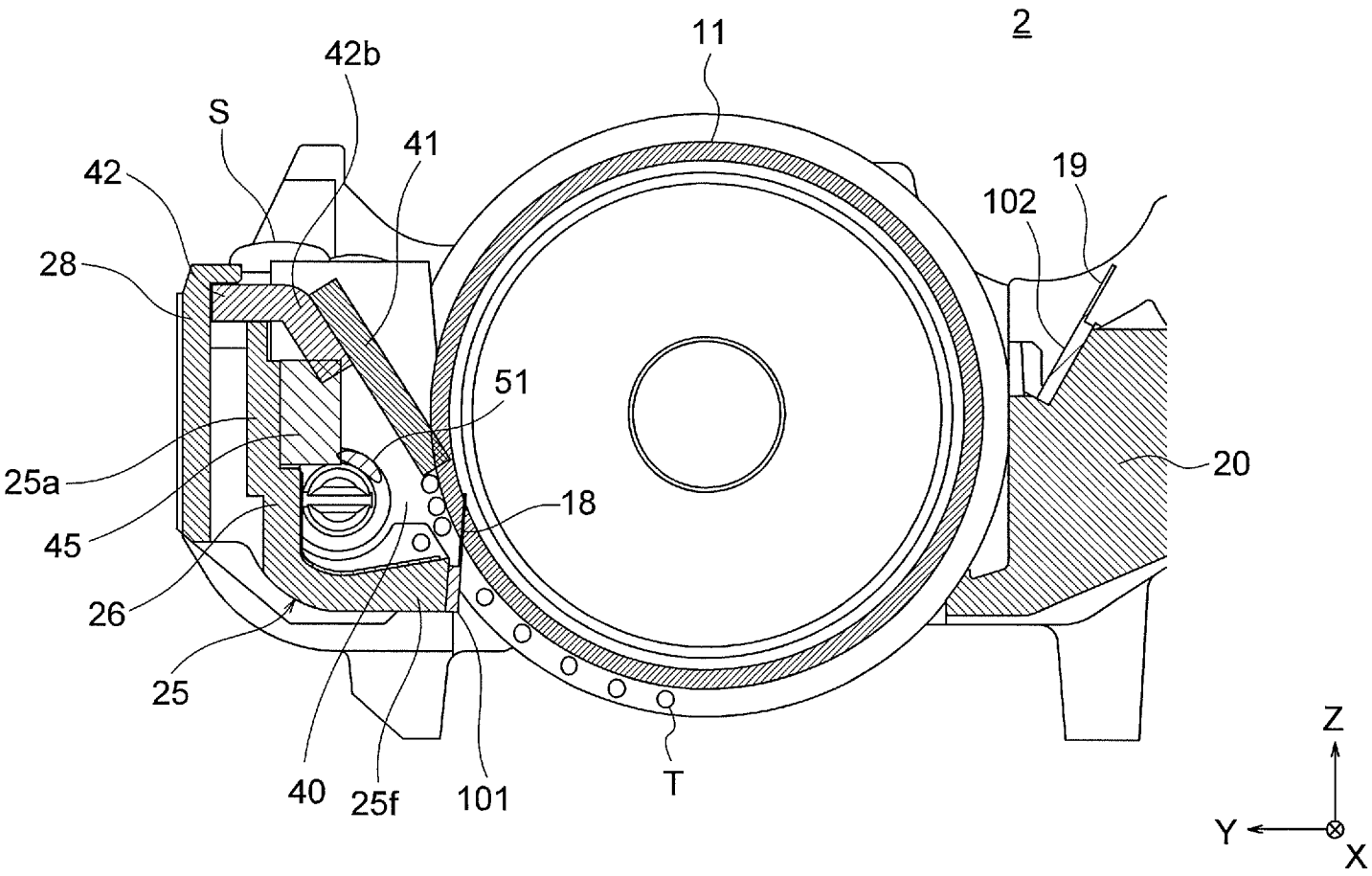
FIG. 11 is a sectional view illustrating a portion including the photosensitive drum, a cleaning blade, and the waste toner conveying spiral of the unit main body according to the first embodiment.
Figure 12:
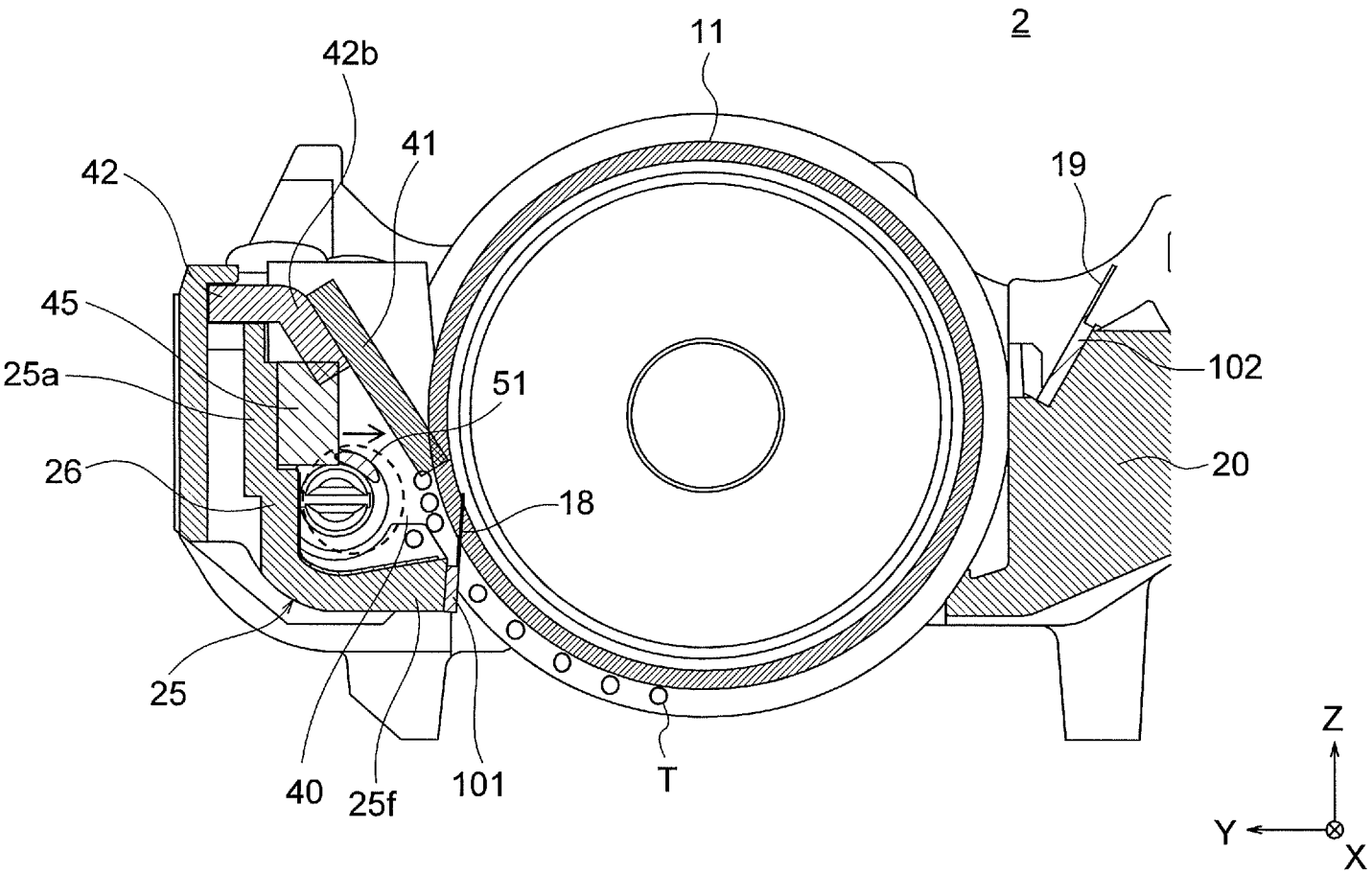
FIG. 12 is another sectional view illustrating the portion including the photosensitive drum, the cleaning blade, and the waste toner conveying spiral of the unit main body according to the first embodiment.

FIGS. 11 and 12 are sectional views taken along a plane parallel to the YZ plane and illustrating a portion including the photosensitive drum 11, the cleaning blade 41, and the waste toner conveying spiral 51 of the unit main body 2. Although the cleaning blade 41 and the seal member 18 are illustrated as being straight in FIGS. 11 and 12, they are curved by being in contact with the surface of the photosensitive drum 11.

As illustrated in FIG. 11, an area surrounded by the first wall portion 25*a* and the bottom plate portion 25*f* of the base frame 25, and the surfaces of the cleaning blade 41 and the photosensitive drum 11 constitutes the waste toner storage section 40. The waste toner storage section 40 will also be referred to as a waste toner conveyance path (i.e., a developer conveyance path).

The transfer residual toner T adhering to the surface of the photosensitive drum 11 passes the seal member 18 and reaches the cleaning blade 41, is scraped by the cleaning blade 41, and is stored in the waste toner storage section 40. The transfer residual toner T is conveyed through the waste toner storage section 40 by the waste toner conveying spiral 51 rotating together with the photosensitive drum 11.

The projecting portion 26 of the base frame 25 pushes the central portion of the waste toner conveying spiral 51 toward the photosensitive drum 11 as illustrated in FIG. 12. In the portion where the waste toner conveying spiral 51 is pushed, a distance to the photosensitive drum 11 is reduced, and thus a space around the waste toner conveying spiral 51 becomes narrow. In this portion, therefore, the waste toner can easily be conveyed.

Figure 13:
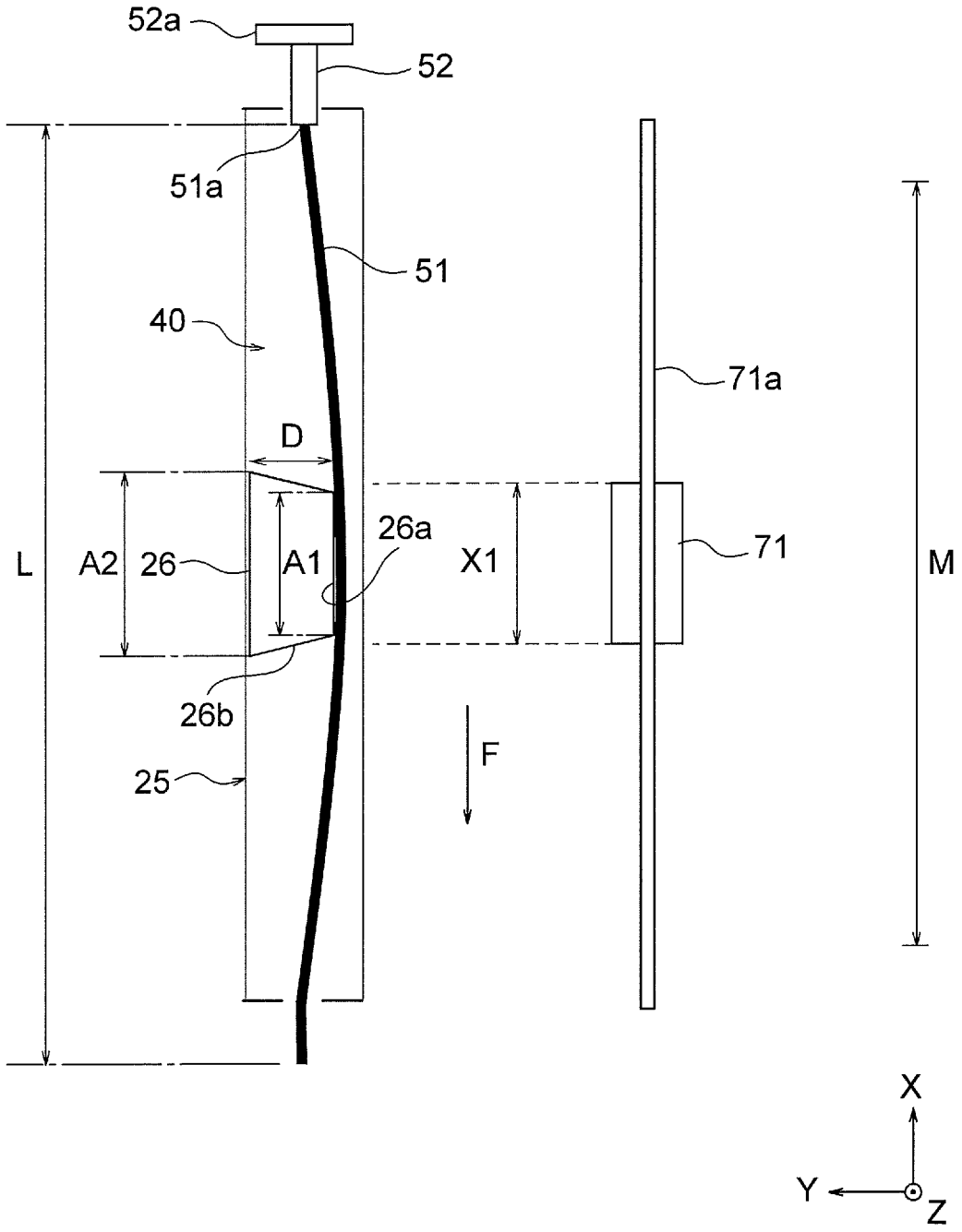
FIG. 13 is a schematic view illustrating a positional relationship among the waste toner conveying spiral, a projecting portion, and a hopping roller according to the first embodiment.

FIG. 13 is a schematic view illustrating a positional relationship among the waste toner conveying spiral 51, the projecting portion 26, and the hopping roller 71. The hopping roller 71 is fixed to a roller shaft 71*a* and disposed at a central portion in the X direction of a medium conveyance path M in the image forming apparatus 1.

More specifically, both of the waste toner conveying spiral 51 and the hopping roller 71 are is disposed at the central portion of the medium conveyance path M in the X direction. In other words, a position of the projecting portion 26 in the X direction overlaps with a position of the hopping roller 71 in the X direction, as indicated by an arrow X1.

In this example, the position of the projecting portion 26 in the X direction and the position of the hopping roller 71 in the X direction fully overlap with each other, but it is sufficient that these positions at least partially overlap with each other.

When the hopping roller 71 delivers the medium P, paper dust sticks to the central portion of the medium P in the X direction due to contact between the hopping roller 71 and the medium P, or contact between the medium P and the feeding roller 72 or the separation pad 73 (FIG. 1).

The paper dust sticking to the medium P is transferred from the medium P to the photosensitive drum 11 when the toner image on the photosensitive drum 11 is transferred to the medium P. Therefore, the toner mixed with the paper dust is scraped by the cleaning blade 41 and falls in the central portion of the waste toner storage section 40 in the X direction.

The waste toner mixed with paper dust has lower flowability than the waste toner mixed with no paper dust. Therefore, the waste toner mixed with the paper dust can hardly be conveyed by the waste toner conveying spiral 51, and may be accumulated at the central portion of the waste toner storage section 40 in the X direction. If the waste toner mixed with the paper dust is accumulated at the central portion of the waste toner storage section 40 in the X direction, the accumulated waste toner may form a wall (bank) and hamper conveyance of other waste toner.

For this reason, in the first embodiment, the projecting portion 26 is provided at the central portion of the waste toner storage section 40 in the X direction so as to push the waste toner conveying spiral 51 toward the photosensitive drum 11. Since the waste toner conveying spiral 51 pushed by the projecting portion 26 curves in an arcuate shape toward the photosensitive drum 11, the space around the waste toner conveying spiral 51 is narrow at the central portion of the waste toner storage section 40 in the X direction.

Thus, the waste toner whose flowability is lowered by mixture with paper dust can easily be conveyed by the waste toner conveying spiral 51, and is not accumulated at the central portion of the waste toner storage section 40 in the X direction. Thus, the waste toner mixed with the paper dust can be efficiently conveyed by the waste toner conveying spiral 51. This inhibits leakage of the waste toner from the waste toner storage section 40.

Since the waste toner conveying spiral 51 is pushed by the projecting portion 26 and is curved, a curved state of the waste toner conveying spiral 51 is constant regardless of an operation state of the image forming apparatus 1. Thus, the waste toner conveying spiral 51 maintains a constant conveyance capability.

The waste toner conveying spiral 51 rotates in contact with the projecting portion 26. However, since the waste toner conveying spiral 51 is made of a metal such as stainless steel, and the projecting portion 26 (as a part of the base frame 25) is made of resin such as PPE/PS, wear of the waste toner conveying spiral 51 and the projecting portion 26 is at a negligible level.

In this regard, if the waste toner conveying spiral 51 is disposed closer to the photosensitive drum 11 as a whole, a capacity (volume) of the waste toner storage section 40 decreases, and thus the waste toner conveyance capability may decrease. In this embodiment, the waste toner conveying spiral 51 is disposed closer to the photosensitive drum 11 only at a portion where the waste toner mixed with paper dust exists. Therefore, the waste toner whose flowability is lowered by mixture with paper dust can be prevented from being accumulated, and decrease in the waste toner conveyance capability can be inhibited.

In FIG. 13, exemplary dimensions of the projecting portion 26 are as follows. Assuming that an entire length L of the waste toner conveying spiral 51 in the X direction is 316.5 mm, a length A1 of a tip portion (i.e., the central portion 26*a*) of the projecting portion 26 in the X direction is, for example, 50.5 mm, and a length A2 of a root portion of the projecting portion 26 in the X direction is, for example, 71.1 mm. A projecting amount D of the projecting portion 26 is, for example, 1.1 mm. In order to enhance conveyance efficiency by moderately curving the waste toner conveying spiral 51 in an arcuate shape, the projecting amount D of the projecting portion 26 is desirably in a range of 0.3 to 1.1 mm.

In the foregoing description, the position of the projecting portion 26 in the X direction overlaps with the position of the hopping roller 71 in the X direction. In this regard, the feeding roller 72 and the separation pad 73 are also located at the central portion of the medium conveyance path M in the X direction, and have widths (dimensions in the X direction) substantially equal to the width of the hopping roller 71 in the X direction. Accordingly, it can be said that the position of the projecting portion 26 in the X direction overlaps with the position of the feeding roller 72 in the X direction, or the position of the separation pad 73 in the X direction.

<Control System of Image Forming Apparatus>

Next, a control system of the image forming apparatus 1 will be described. FIG. 14 is a block diagram illustrating the control system of the image forming apparatus 1. The image forming apparatus 1 includes a controller 200, an I/F (interface) controller 201, a reception memory 202, an image data editing memory 203, an operation section 204, sensors 205, a power supply controller 207, a head controller 212, a driving controller 213, a belt driving controller 214, a fixing controller 215, a fixing driving controller 216, and a feeding and conveying controller 217.

The controller 200 includes, for example, a microprocessor, a ROM (Read Only Memory), a RAM (Random Access Memory), an input/output port, and a timer. The controller 200 receives print data and control command from a host device via the I/F controller 201 and controls the operation of the image forming apparatus 1.

The reception memory 202 temporarily stores the print data input from the host device via the I/F controller 201. The image data editing memory 203 receives the print data stored in the reception memory 202, and stores image data formed by editing the print data.

The operation section 204 includes a display (for example, LEDs) for displaying a state of the image forming apparatus 1, and an operation unit (for example, a switch) with which an operator inputs instructions. The sensors 205 include various sensors for monitoring the operation state of the image forming apparatus 1. For example, the sensors 205 include a sheet position sensor, a temperature and humidity sensor, and a density sensor.

The power supply controller 207 controls a charging voltage power source 208, a developing voltage power source 209, a supplying voltage power source 210, and a transfer voltage power source 211. The charging voltage power source 208 applies a charging voltage to the charging roller 12. The developing voltage power source 209 applies a developing voltage to the developing roller 15. The supplying voltage power source 210 applies a supplying voltage to the supplying roller 16. The transfer voltage power source 211 applies a transfer voltage to the transfer roller 81. The head controller 212 sends the image data stored in the image data editing memory 203 to the printing head 13 and controls light emission of the printing head 13.

The driving controller 213 controls the driving motor 219 for rotating the photosensitive drum 11 of each process unit 10. The charging roller 12 rotates to follow the rotation of the photosensitive drum 11, and the developing roller 15 and the supplying roller 16 rotate by rotation transmitted from the photosensitive drum 11. The belt driving controller 214 controls a belt motor 220 for driving the transfer belt 82.

The fixing controller 215 includes a temperature control circuit, and supplies a current to the heater 221 of the fixing device 9 according to a signal output from a thermistor 222 of the fixing device 9. The fixing driving controller 216 controls the fixing motor 223 for rotating the fixing roller 91 (FIG. 1) of the fixing device 9.

The feeding and conveying controller 217 controls a feeding and conveying motor 224 and electromagnetic clutches 225 for rotating the hopping roller 71, the feeding roller 72, and the conveying rollers 74 and 75.

<Operation of Image Forming Apparatus>

Next, an operation of the image forming apparatus 1 will be described with reference to FIGS. 1 and 14. The image forming apparatus 1 performs an image forming operation in a state where the toner cartridge 3 is mounted on the unit main body 2 of each process unit 10 as described above.

The controller 200 of the image forming apparatus 1 starts the image forming operation, upon receiving print command and print data from the host device via the I/F controller 201. The controller 200 temporarily stores the print data in the reception memory 202, creates image data by editing the stored print data, and stores the image data in the image data editing memory 203.

The controller 200 causes the feeding and conveying controller 217 to drive the feeding and conveying motor 224 and the electromagnetic clutches 225 to rotate the hopping roller 71 and the feeding roller 72. The hopping roller 71 delivers the medium P from the tray 70, and the feeding roller 72 feeds the delivered medium P to the medium conveyance path. The conveying rollers 74 and 75 rotate and convey the medium P (fed to the medium conveyance path) to the image forming section 5.

The controller 200 causes the belt driving controller 214 to drive the belt motor 220 so as to rotate the driving roller 83 and make the transfer belt 82 travel. The transfer belt 82 holds the medium P by suction, and conveys the medium P. The medium P passes through the process units 10K, 10Y, 10M, and 10C in this order.

The controller 200 performs image formation in each process unit 10 to form a toner image of the corresponding color. More specifically, the controller 200 causes the power supply controller 207 to apply the charging voltage, the developing voltage, and the supplying voltage to the charging roller 12, the developing roller 15, and the supplying roller 16, respectively, of each process unit 10.

The controller 200 also causes the driving controller 213 to rotate the driving motor 219 to rotate the photosensitive drum 11. As the photosensitive drum 11 rotates, the charging roller 12, the developing roller 15, and the supplying roller 16 also rotate. The charging roller 12 uniformly charges the surface of the photosensitive drum 11 with the charging voltage.

The controller 200 causes the head controller 212 to control light emission of the printing head 13 according to the image data of each color. The printing head 13 emits light to expose the surface of the photosensitive drum 11 to form an electrostatic latent image.

The electrostatic latent image formed on the surface of the photosensitive drum 11 is developed by the toner (adhering to the developing roller 15) and a toner image is formed on the surface of the photosensitive drum 11. When the toner image comes close to a surface of the transfer belt 82 by the rotation of the photosensitive drum 11, the power supply controller 207 applies the transfer voltage to the transfer roller 81. With the transfer voltage, the toner image formed on the photosensitive drum 11 is transferred to the medium P on the transfer belt 82.

In this manner, the toner images of the respective colors formed by the process units 10K, 10Y, 10M, and 10C are transferred to the medium P in an overlapping manner. The medium P to which the toner images of respective colors are transferred is further conveyed by the transfer belt 82 and reaches the fixing device 9.

In the fixing device 9, the heater 221 is heated by the fixing controller 215, and the fixing roller 91 is rotated by the fixing motor 223. The medium P conveyed to the fixing device 9 is heated and pressed between the fixing roller 91 and the pressure roller 92, and the toner image is fixed to the medium P.

The medium P with the fixed toner image is ejected outside the image forming apparatus 1 by the ejection rollers 77 and 78 and is stacked on the stacker portion 79. The image forming operation on the medium P is thus completed.

In this image forming operation, the rotation of the photosensitive drum 11 is transmitted to the waste toner conveying spiral 51, and the waste toner conveying spiral 51 rotates. The transfer residual toner adhering to the surface of the photosensitive drum 11 passes the seal member 18 to reach the cleaning blade 41, and is scraped by the cleaning blade 41, as illustrated in FIG. 12.

The toner scraped by the cleaning blade 41 falls into the waste toner storage section 40 and is conveyed in the conveying direction (the direction indicated by the arrows F in FIGS. 6 to 10) by the waste toner conveying spiral 51.

The waste toner conveyed by the waste toner conveying spiral 51 reaches the waste toner conveying belt 62 (FIG. 7) in the side frame 22 through the cylindrical portion 53 (FIG. 6), is conveyed to the waste toner supplying section 61 (FIG.

6) by the waste toner conveying belt 62, and is stored in the waste toner storage chamber 302 (FIG. 2) of the toner cartridge 3.

As described above, paper dust on the medium P generated by contact between the medium P and the hopping roller 71 (or the feeding roller 72 or the separation pad 73) sticks to the central portion of the photosensitive drum 11 in the X direction upon transferring of the toner image. The toner mixed with the paper dust is scraped by the cleaning blade 41 and falls in the central portion of the waste toner storage section 40 in the X direction.

At the central portion of the waste toner storage section 40 in the X direction, the waste toner conveying spiral 51 is pushed toward the photosensitive drum 11 by the projecting portion 26, and thus the space around the waste toner conveying spiral 51 is narrow. Therefore, the waste toner whose flowability is lowered by mixture with paper dust is efficiently conveyed by the waste toner conveying spiral 51, and accumulation of the waste toner is inhibited. This makes it possible to inhibit leakage of the waste toner from the waste toner storage section 40.

FIGS. 15A to 15D are schematic views illustrating the waste toner storage section 40 and its surroundings, after the process unit 10 is mounted on the main body of the image forming apparatus 1 and until the image forming operation is completed.

Figure 15A:
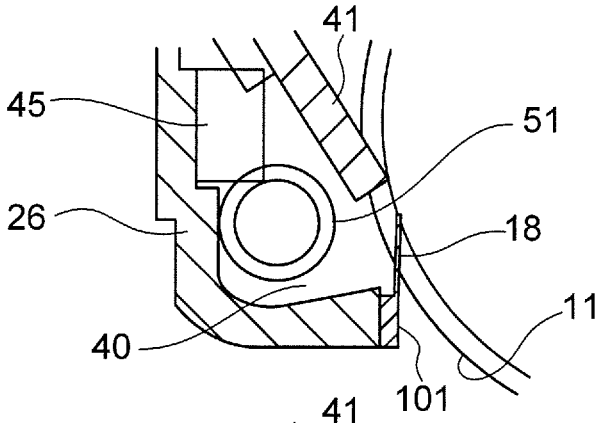
FIGS. 15A to 15D are schematic views illustrating a waste toner storage section and its surroundings according to the first embodiment.

In a state illustrated in FIG. 15A, the process unit 10 is mounted on the main body of the image forming apparatus 1, but the image forming operation is not yet started. In this state, no waste toner is stored in the waste toner storage section 40.

Figure 15B:
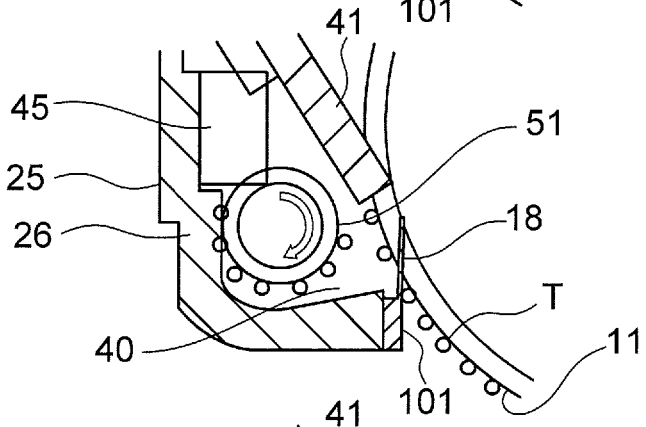

As illustrated in FIG. 15B, when the image forming operation is started, the toner (i.e., the transfer residual toner) adhering to the surface of the photosensitive drum 11 is scraped by the cleaning blade 41, and falls and is stored in the waste toner storage section 40.

Figure 15C:
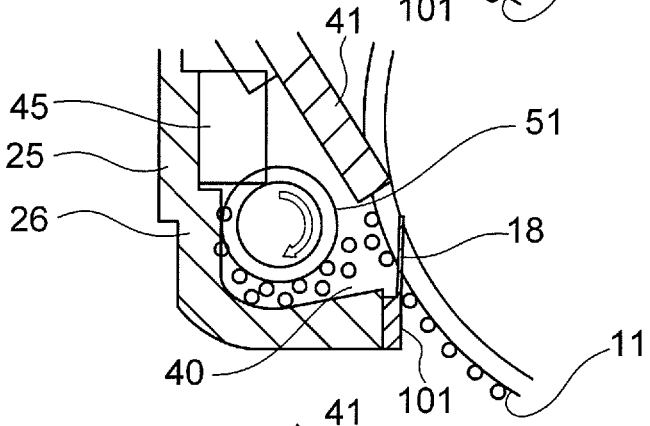

As illustrated in FIG. 15C, as the image forming operation proceeds, the amount of waste toner stored in the waste toner storage section 40 increases. In the waste toner storage section 40, the waste toner reaching the height of the waste toner conveying spiral 51 is conveyed by the waste toner conveying spiral 51.

Figure 15D:
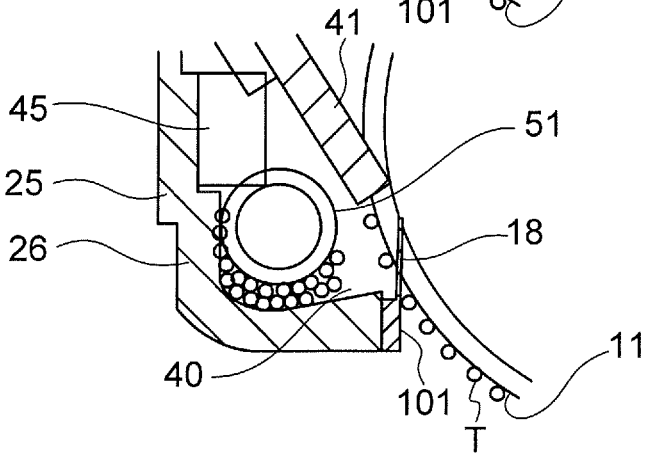

As illustrated in FIG. 15D, when the image forming operation is stopped, the waste toner conveying spiral 51 stops conveying the waste toner. In the above described state illustrated in FIG. 15C, the waste toner is efficiently conveyed by the waste toner conveying spiral 51, and thus accumulation of the waste toner is inhibited.

In the operation states illustrated in FIGS. 15A to 15D, a curved state of the waste toner conveying spiral 51 (i.e., the curved state illustrated in FIG. 10) is constant. Thus, the conveyance capability of the waste toner conveying spiral 51 can be kept constant.

Effects of First Embodiment

As described above, the process unit (image forming unit) 10 according to the first embodiment includes the waste toner storage section (developer storage section) 40, the base frame (frame) 25 surrounding the waste toner storage section 40, and the waste toner conveying spiral 51 that conveys the waste toner in the waste toner storage section 40 in the predetermined conveying direction. The base frame 25 has the projecting portion (convex portion) 26 that pushes the waste toner conveying spiral 51 toward the photosensitive drum 11.

The waste toner conveying spiral 51 is curved toward the photosensitive drum 11 by the projecting portion 26, and thus the waste toner conveyance efficiency is enhanced. As a result, the waste toner whose flowability is lowered by mixture with paper dust can be efficiently conveyed, and leakage of the waste toner can be inhibited.

In particular, the projecting portion 26 is disposed at the central portion of the waste toner storage section 40 in the X direction. Thus, in the image forming apparatus 1 having the hopping roller 71 disposed at the central portion in the X direction, the waste toner mixed with paper dust generated when the medium P is delivered by the hopping roller 71 can be efficiently conveyed by the waste toner conveying spiral 51.

The position of the projecting portion 26 in the X direction at least partially overlaps with the position of the hopping roller 71 in the X direction. Hence, the waste toner mixed with paper dust generated when the medium P is delivered by the hopping roller 71 can be efficiently conveyed by the waste toner conveying spiral 51.

The projecting portion 26 includes inclined portions 26*b* on both sides in the X direction. Hence, the waste toner conveying spiral 51 can be smoothly curved in an arcuate shape, and the rotation load of the waste toner conveying spiral 51 can thus be reduced.

Since the waste toner conveying spiral 51 is formed by a spirally wound wire, the waste toner conveying spiral 51 can be curved by being pushed by the projecting portion 26, and can convey the waste toner while rotating in the curved state.

Since the wire of the waste toner conveying spiral 51 is made of metal, the waste toner conveying spiral 51 is not damaged even when it rotates in contact with the projecting portion 26.

The conveying direction of the waste toner by the waste toner conveying spiral 51 is parallel to the rotation axis of the photosensitive drum 11. Hence, the waste toner scraped from the photosensitive drum 11 can be conveyed to one end of the photosensitive drum 11 in the axial direction, and then the waste toner can be conveyed therefrom to a predetermined storage chamber (for example, the waste toner storage chamber 302 of the toner cartridge 3).

The rotation of the photosensitive drum 11 is transmitted to the waste toner conveying spiral 51 by the transmission gear (rotation transmitting member) 54. Hence, the waste toner can be conveyed using the rotation of the photosensitive drum 11, and it is not necessary to provide an independent drive source.

The projecting portion 26 projects from the first wall portion 25*a* of the base frame 25 toward the photosensitive drum 11. Hence, the waste toner conveying spiral 51 can be curved with a simple structure, and the conveyance efficiency can be enhanced.

Since the cleaning blade 41 is provided, the toner adhering to the surface of the photosensitive drum 11 can be scraped therefrom and fall into the waste toner storage section 40.

The sponge member 45 is disposed in contact with the waste toner conveying spiral 51. Hence, the waste toner conveyance efficiency can be enhanced by limiting the capacity of the waste toner storage section 40.

The gap between the base frame 25 and the photosensitive drum 11 is closed by the seal member (film member) 18. Hence, leakage of the waste toner from the waste toner storage section 40 can be inhibited.

First Modification

Figure 16:
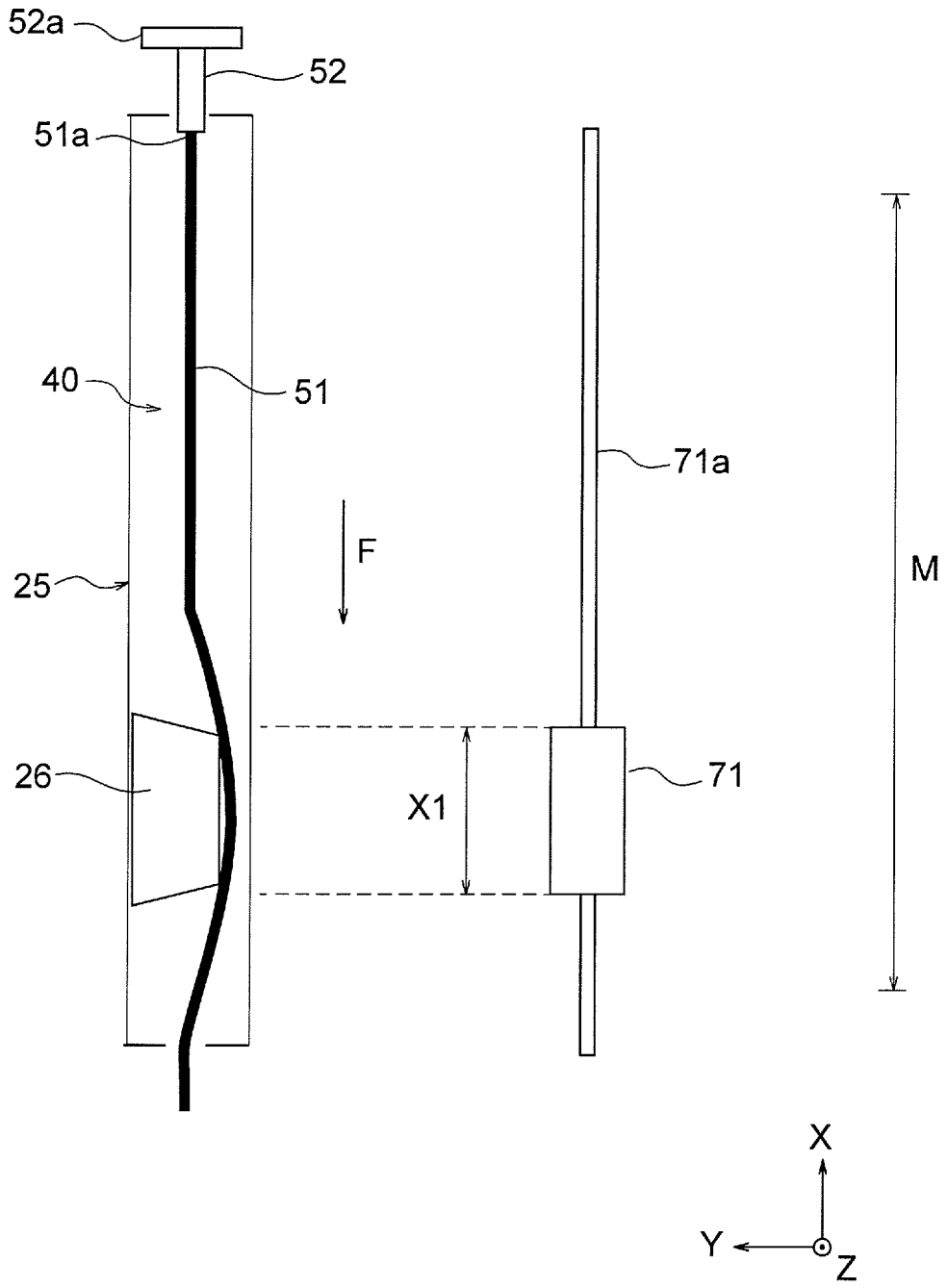
FIG. 16 is a schematic view illustrating a positional relationship among a waste toner conveying spiral, a projecting portion, and a hopping roller according to a first modification of the first embodiment.

Next, a first modification of the first embodiment will be described. FIG. 16 is a schematic view illustrating a positional relationship among a waste toner conveying spiral 51, a projecting portion 26, and a hopping roller 71 in the first modification.

In the above described first embodiment, both of the projecting portion 26 and the hopping roller 71 are disposed at the central portion of the medium conveyance path M in the X direction (see FIG. 13). In contrast, in the first modification, both of the projecting portion 26 and the hopping roller 71 are disposed on the −X side (i.e., a downstream side along the conveying direction indicated by the arrow F) of the central portion of the medium conveyance path M in the X direction.

Even in the first modification, the position of the projecting portion 26 in the X direction overlaps with the position of the hopping roller 71 in the X direction, as indicated by an arrow X1. More specifically, the waste toner conveying spiral 51 is pushed toward the photosensitive drum 11 by the projecting portion 26 located in correspondence with the position of the hopping roller 71 in the X direction. Therefore, the waste toner whose flowability is lowered by mixture with paper dust can be efficiently conveyed by the waste toner conveying spiral 51. This makes it possible to inhibit accumulation of the waste toner.

If the waste toner conveying spiral 51 is disposed closer to the photosensitive drum 11 as a whole, the capacity of the waste toner storage section 40 decreases, and thus the waste toner conveyance capability may decrease. In the first modification, the waste toner conveying spiral 51 is disposed closer to the photosensitive drum 11 only at a portion where the waste toner mixed with paper dust falls. Therefore, accumulation of the waste toner mixed with paper dust can be inhibited, and decrease in the waste toner conveyance capability can be inhibited.

FIG. 16 illustrates the positional relationship between the projecting portion 26 and the hopping roller 71. However, the feeding roller 72 and the separation pad 73 (FIG. 1) are disposed on the −X side of the central portion of the medium conveyance path M in the X direction similarly to the hopping roller 71, and have widths (dimensions in the X direction) substantially equal to that of the hopping roller 71. Accordingly, it can be said that the position of the projecting portion 26 in the X direction overlaps with the position of the feeding roller 72 in the X direction, or the position of the separation pad 73 in the X direction.

Second Modification

Figure 17:
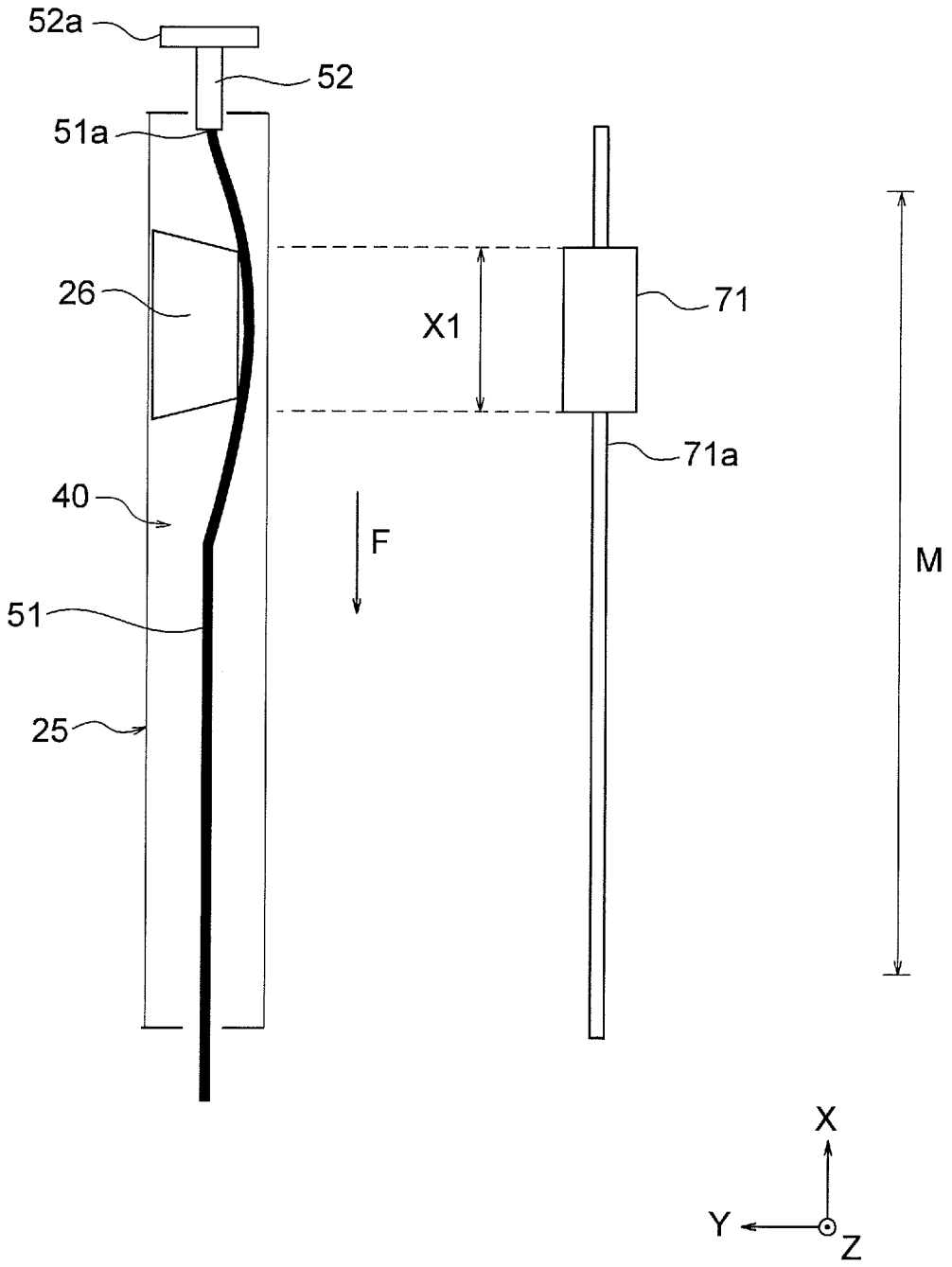
FIG. 17 is a schematic view illustrating a positional relationship among a waste toner conveying spiral, a projecting portion, and a hopping roller according to a second modification of the first embodiment.

Next, a second modification to the first embodiment will be described. FIG. 17 is a schematic view illustrating a positional relationship among a waste toner conveying spiral 51, a projecting portion 26, and a hopping roller 71 in the second modification.

In the second modification, both of the projecting portion 26 and the hopping roller 71 are disposed on the +X side (i.e., an upstream side along the conveying direction indicated by the arrow F) of the central portion of the medium conveyance path M in the X direction.

Even in the second modification, the position of the projecting portion 26 in the X direction overlaps with the position of the hopping roller 71 in the X direction, as indicated by an arrow X1. More specifically, the waste toner conveying spiral 51 is pushed toward the photosensitive drum 11 by the projecting portion 26 located in correspondence with the position of the hopping roller 71 in the X direction. Therefore, the waste toner whose flowability is lowered by mixture with paper dust can be efficiently conveyed by the waste toner conveying spiral 51. This makes it possible to inhibit accumulation of the waste toner.

If the waste toner conveying spiral 51 is disposed closer to the photosensitive drum 11 as a whole, the capacity of the waste toner storage section 40 decreases, and thus the waste toner conveyance capability may decrease. In the second modification, the waste toner conveying spiral 51 is disposed closer to the photosensitive drum 11 only at a portion where the waste toner mixed with paper dust falls. Therefore, accumulation of the waste toner mixed with paper dust can be inhibited, and decrease in the waste toner conveyance capability can be inhibited.

FIG. 17 illustrates the positional relationship between the projecting portion 26 and the hopping roller 71. However, the feeding roller 72 and the separation pad 73 (FIG. 1) are disposed on the +X side of the central portion of the medium conveyance path M in the X direction similarly to the hopping roller 71, and have widths (dimensions in the X direction) substantially equal to that of the hopping roller 71. Accordingly, it can be said that the position of the projecting portion 26 in the X direction overlaps with the position of the feeding roller 72 in the X direction, or the position of the separation pad 73 in the X direction.

An image forming apparatus that forms a color image has been described in the above described embodiments. However, the present invention is also applicable to an image forming apparatus that forms a single-color (monochrome) image. The present invention may be applied to, for example, an image forming apparatus (e.g., a copier, a facsimile machine, a printer, or a multifunction peripheral) that forms an image on a medium using an electrophotographic scheme.

While the preferred embodiments of the present invention have been illustrated in detail, it should be apparent that modifications and improvements may be made to the invention without departing from the spirit and scope of the invention as described in the following claims.

DESCRIPTION OF REFERENCE CHARACTERS

1 image forming apparatus; 2 unit main body; 3 toner cartridge (developer storage body); 5 image forming section; 7A medium supplying section; 7B medium ejection section; 8 transfer unit; 9 fixing device; 10, 10K, 10Y, 10M, 10C process unit (image forming unit); 11 photosensitive drum (image bearing body); 11*a* drum gear; 12 charging roller (charging member); 13, 13K, 13Y, 13M, 13C printing head (exposure device); 14 developing section; 15 developing roller (developer bearing body); 16 supplying roller (supplying member); 17 developing blade (developer regulation member); 18, 19 seal member (film member); 20 main body frame; 22 side frame; 25 base frame (frame); 25*a* first wall portion; 25*b* second wall portion; 25*c*, 25*d* side wall portion; 25*e* opening; 25*f* bottom plate portion; 26 projecting portion (convex portion); 26*a* central portion; 26*b* inclined portion; 29 mounting section; 30 outer case; 40 waste toner storage section; 41 cleaning blade (cleaning member); 42 blade holder; 45 sponge member; 51 waste toner conveying spiral (developer conveying member); 52 spiral holder; 52*a* gear portion; 52*b* shaft portion; 53 cylindrical portion; 54 transmission gear (rotation transmitting member); 61 waste toner supplying section; 62 waste toner conveying belt (conveying member); 70 tray (medium storage section); 71 hopping roller (delivery member); 71*a* roller shaft; 72 feeding roller; 73 separation pad; 74, 75 conveying rollers; 77, 78 discharging rollers; 200 controller.

What is claimed is:

1. An image forming unit comprising:

an image bearing body;

a developer storage section that stores a developer removed from a surface of the image bearing body;

a frame surrounding the developer storage section;

a developer conveying member that conveys the developer in the developer storage section in a predetermined conveying direction; and a convex portion that is provided in the frame and pushes the developer conveying member toward the image bearing body.

2. The image forming unit according to claim 1, wherein the convex portion is located at a central portion of the developer storage section in the conveying direction.

3. The image forming unit according to claim 2, wherein the convex portion includes inclined portions provided on both sides of the convex portion in the conveying direction, the inclined portions being inclined with respect to the conveying direction.

4. The image forming unit according to claim 1, wherein the image forming unit forms an image on a medium supplied from a medium supplying section having a delivery member that delivers the medium, and wherein a position of the convex portion in the conveying direction at least partially overlaps with a position of the delivery member in the conveying direction.

5. The image forming unit according to claim 4, wherein the convex portion is located at one side of a central portion of the developer storage section in the conveying direction.

6. The image forming unit according to claim 1, wherein the developer conveying member comprises a spiral formed by a spirally wound wire.

7. The image forming unit according to claim 6, wherein the wire is made of metal.

8. The image forming unit according to claim 1, wherein the image bearing body is rotatable about a rotation axis, and the conveying direction is parallel with a direction of the rotation axis of the image bearing body.

9. The image forming unit according to claim 8, further comprising a rotation transmitting member that transmits rotation of the image bearing body to the developer conveying member.

10. The image forming unit according to claim 1, wherein the convex portion comprises a projecting portion that projects from an inner surface of the frame toward the developer conveying member.

11. The image forming unit according to claim 1, further comprising a cleaning member that removes the developer from the surface of the image bearing body.

12. The image forming unit according to claim 11, wherein the developer conveying member is disposed below the cleaning member.

13. The image forming unit according to claim 1, further comprising a sponge member disposed in contact with the developer conveying member.

14. The image forming unit according to claim 1, further comprising a film member that closes a gap between the frame and the image bearing body.

15. The image forming unit according to claim 1, further comprising:

a charging member that charges the surface of the image bearing body; and a developing section that develops a latent image formed on the surface of the image bearing body.

16. An image forming apparatus comprising:

a medium supplying section that supplies a medium, the medium supplying section comprising a delivery member that delivers the medium;

the image forming unit according to claim 1, the image forming unit forming an image on the medium supplied from the medium supplying section; and a fixing device that fixes the image formed on the medium by the image forming unit.

* * * * *